US006460958B2

(12) United States Patent
Kubo et al.

(10) Patent No.: US 6,460,958 B2
(45) Date of Patent: Oct. 8, 2002

(54) THREE-DIMENSIONAL OBJECT PRINTING APPARATUS AND METHOD

(75) Inventors: Naoki Kubo, Nishinomiya; Jun Koreishi, Amagasaki; Hideaki Nakanishi, Osaka; Koji Yamamoto, Kawanishi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/793,636

(22) Filed: Feb. 27, 2001

(65) Prior Publication Data

US 2001/0019340 A1 Sep. 6, 2001

(30) Foreign Application Priority Data

Feb. 29, 2000 (JP) ..... 2000-053985
Apr. 18, 2000 (JP) ..... 2000-116494

(51) Int. Cl.[7] ..... B41J 3/00
(52) U.S. Cl. ..... 347/2
(58) Field of Search ..... 347/1, 2, 4, 8, 347/14

(56) References Cited

U.S. PATENT DOCUMENTS 5,144,330 A * 9/1992 Bennet ..... 347/2
5,280,305 A 1/1994 Monroe et al.
5,831,641 A * 11/1998 Carlson ..... 347/2
5,931,166 A * 8/1999 Weber et al. ..... 132/73
6,341,831 B1 * 1/2002 Weber et al. ..... 347/1

FOREIGN PATENT DOCUMENTS

JP 5-318715 12/1993

* cited by examiner

*Primary Examiner*—John Barlow
*Assistant Examiner*—Michael S Brooke
(74) *Attorney, Agent, or Firm*—McDermott, Will & Emery

(57) ABSTRACT

Ejection nozzles (152*a*–152*g*) are located in a nozzle surface (153) of an ejection head (150). A distance (H: Ha–Hg) between each of the ejection nozzles (152*a*–152*g*) and a printing object (109) is obtained and compared with a permissible distance (H0) which is determined by the required level of print quality. The ejection nozzles (152*a*–152*d*) whose distances (H) from the printing object (109) are not more than the permissible distance (H0) are enabled for ink ejection, while the ejection nozzles (152*e*–152*g*) whose distances (H) are greater than the permissible distance (H0) are disabled for ink ejection. The surface of a printing object (228) is divided into a plurality of target areas (205), each of which is then approximated by a projective plane (206). Then, image data about a projected image (208) which is obtained by orthogonal projection of a print image (207) onto the projective planes (206), is obtained from print image data about an image to be printed on the surface of the printing object (228). According to the projected image data obtained, printing is performed on the target area (205) while moving a ink-jet printhead (210) in parallel with the projective planes (206). This inhibits image degradation during printing on a three-dimensional printing object and also facilitates control of the inclination and position of the ejection head relative to the printing object, thereby permitting high-speed printing.

14 Claims, 28 Drawing Sheets

SUB-SCANNING DIRECTION Y

MAIN SCANNING DIRECTION $H_{max} + \delta \leqq L$ $H_{max} + \delta > L$

THREE-DIMENSIONAL OBJECT PRINTING APPARATUS AND METHOD

This application is based on the applications Nos. 2000–53985 and 2000–116494 filed in Japan, the contents of which are hereby incorporated by reference.

BACKGROUND OF THE INVENTION

1. Field of the Invention

The present invention relates to a three-dimensional object printing apparatus and method for printing (image recording) on a three-dimensional printing object (three-dimensional object).

2. Description of the Background Art

Previously known printing apparatuses print a desired image and the like by ejecting ink on printing paper using an ink jet technique or the like. In such printing apparatuses, an ejection head ejects ink while continuously moving in a main scanning direction. Upon completion of a single line of printing in the main scanning direction, the ejection head is moved a fixed distance in a sub-scanning direction orthogonal to the main scanning direction and then starts the next printing operation in the main scanning direction. To improve the efficiency of such printing operations, the ejection head may be a multinozzle head with a plurality of ejection nozzles.

With the technique of ejecting ink from such a multinozzle ejection head by using the ink jet technique or the like, an attempt is now being made to perform printing on a three-dimensional printing object.

In the manufacture of the ejection head with a plurality of ejection nozzles, however, variations occur in the machining accuracy of the ejection nozzles. Further, water-repellent treatment, which is applied to around nozzle bores of the respective ejection nozzles for the prevention of adhesion of ink droplets, may be nonuniform.

Because of those factors, when the ejection head with a plurality of ejection nozzles ejects ink, the angles (directions) of ink ejection can vary from ejection nozzle to ejection nozzle.

FIGS. 32A and 32B show the directions of ink ejection from an ejection nozzle. FIG. 32A illustrates ink ejection from an ejection nozzle with high machining accuracy and uniform water repellency, and FIG. 32B illustrates ink ejection from an ejection nozzle with low machining accuracy or nonuniform water repellency.

From an ejection nozzle 152 with high machining accuracy and uniform water repellency as shown in FIG. 32A, ink is ejected in the direction of the normal to the ejection nozzle 152 and an ink droplet strikes precisely at a position PA on a printing object where a dot is to be formed.

From an ejection nozzle 152 with low machining accuracy or nonuniform water repellency as shown in FIG. 32B, on the other hand, ink is ejected in a direction that deviates from the direction of the normal to the ejection nozzle 152 and an ink droplet strikes not at the position PA on a printing object where a dot is to be formed but at a position PB responsive to the deviation in the direction of ink ejection. In this case, a striking position error h occurs between the desired dot forming position PA and the actual dot forming position PB, which reduces the precision of printing.

Generally in the manufacture of multinozzle ejection heads, it is difficult to manufacture all ejection nozzles with a high degree of precision and uniform water repellency as shown in FIG. 32A. Instead, many ejection nozzles produce a fixed error in the direction of ink ejection as shown in FIG. 32B. The problem here is thus how to reduce the striking position error h as above described.

Further, since the ejection head continuously moves in the main scanning direction during a printing operation, nonuniform speeds of ink ejection from the respective ejection nozzles also cause variations in the direction of ink ejection therefrom. This produces the striking position error h as above described, resulting in degradation in image quality.

In printing on a planar object such as printing paper, the striking position error h can be reduced by adequately reducing a distance H between each ejection nozzle and the printing object.

In ink ejection on a three-dimensional printing object, on the other hand, the distance H between each ejection nozzle and the printing object cannot be reduced adequately enough to avoid interference therebetween, depending on the shape of the printing object. Further, the distances H between the ejection nozzles and the printing object vary according to the shape of the three-dimensional surface: the greater the distance H, the larger the striking position error h. This further reduces print quality.

Therefore, it is desired to use a multinozzle ejection head for doing printing on a three-dimensional printing object without image degradation.

There also have been previously known three-dimensional object printing apparatuses for printing on surfaces having three-dimensional geometry. For example, the technique disclosed in Japanese Patent Application Laid-Open No. 5-318715(1993) provides a mechanism for supporting an ink-jet printhead to be vertically movable and adjusting the angle of inclination of a printhead arm, thereby doing printing (coloring) by means of ink ejection from the ink-jet printhead with a predetermined spacing between a printing surface of a three-dimensional printing object and the ink-jet printhead. Such a construction permits surface printing on printing objects which include not only bodies of revolution such as spheres and cones but also different-diameter bodies of revolution such as barrel bodies.

Now, it is desired that the three-dimensional object printing apparatuses can do printing on objects having more common three-dimensional geometry, but in that case it is expected that control of the inclination, the scan path, and the like of the ink-jet printhead will become complicated. Consequently, high-speed printing becomes difficult.

Therefore, it is also desired to facilitate control of the inclination and position of the ink-jet printhead relative to the surface of a three-dimensional object, thereby achieving a high-speed printing operation.

These and other objects, features, aspects and advantages of the present invention will become more apparent from the following detailed description of the present invention when taken in conjunction with the accompanying drawings.

SUMMARY OF THE INVENTION

The present invention is directed to an apparatus for supplying ink to the surface of a three-dimensional object.

According to an aspect of the present invention, the apparatus comprises: a holding section for holding the three-dimensional object in any desired attitude with respect to three axial directions; an ejection section for ejecting ink; a mechanism for positioning the ejection section in any desired three-dimensional position while maintaining the attitude thereof with respect to the three-dimensional object which is held by the holding section; and a controller for controlling the mechanism such that the ejection section performs two-dimensional scanning of a predetermined area of the three-dimensional object which is held in a certain attitude.

This apparatus facilitates control of the inclination and position of the ejection section relative to the surface of the three-dimensional object, thereby achieving a high-speed printing operation.

According to another aspect of the present invention, the apparatus comprises: an ejection section for ejecting ink; a mechanism for changing relative positions and relative attitudes of the ejection section and the three-dimensional object; a processing section for approximating a predetermined area of the surface of the three-dimensional object by a flat face; and a controller for controlling the mechanism to change the relative positions of the ejection section and the three-dimensional object while maintaining the relative attitudes thereof in a plane parallel to the flat face.

As compared with the apparatuses for printing an image in accordance with the shape of the three-dimensional object, this apparatus facilitates control of the inclination and position of the ejection section relative to the surface of the three-dimensional object, thereby permitting high-speed printing.

According to still another aspect of the present invention, the apparatus comprises: an ejection head with a plurality of nozzles for ejecting ink to the surface of the three-dimensional object located opposite the nozzles; a scanning section for causing the ejection head to scan the surface of the three-dimensional object; and a controller for enabling predetermined nozzles and disabling the other nozzles out of the plurality of nozzles in accordance with a shape of the surface of the three-dimensional object located opposite the ejection head, thereby to control scanning by the scanning section and ink ejection by the ejection head.

This apparatus permits proper printing on a three-dimensional printing object without image degradation.

According to still another aspect of the present invention, the apparatus comprises: a table to place the three-dimensional object, the table being rotatable about an axis perpendicular to a placing surface of the table; an ejection head with a plurality of nozzles for ejecting ink, the ejection head being capable of being positioned in any desired position in three-dimensional space; and a controller for controlling ink ejection from the ejection head in response to rotation of the table, by rotating the table with the ejection head in a predetermined position in three-dimensional space so that ink is supplied to the three-dimensional object with a predetermined width in a direction of the axis.

This apparatus permits proper and high-speed printing on a three-dimensional printing object without image degradation.

The present invention is also directed to a method of supplying ink to the surface of a three-dimensional object.

According to an aspect of the present invention, the method comprises the steps of: a) approximating a portion of the surface of the three-dimensional object by a flat face; b) fixing the inclination of the flat face of the step a) to a predetermined inclination; and c) supplying ink to the surface of the three-dimensional object while performing two-dimensional scanning in a plane parallel to the flat face of step b).

This method permits a high-speed printing operation as compared with that of controlling a printing operation in accordance with the shape of a three-dimensional object.

According to another aspect of the present invention, the method comprises the steps of: a) locating the three-dimensional object opposite an ejection head with a plurality of nozzles for ejecting ink; b) causing the ejection head to scan the surface of the three-dimensional object; and c) enabling predetermined nozzles and disabling the other nozzles out of the plurality of nozzles in accordance with a shape of the surface of the three-dimensional object located opposite the ejection head, thereby to eject ink from the enabled nozzles during the scanning.

This method permits proper printing on a three-dimensional printing object without image degradation.

According to still another aspect of the present invention, the method comprises the steps of: placing the three-dimensional object on a table which is rotatable about an axis perpendicular to a placing surface of the table; and rotating the table with an ejection head with a plurality of nozzles for ejecting ink being in a predetermined position in three-dimensional space, and ejecting ink from the ejection head in response to rotation of the table so that ink is supplied to the three-dimensional object with a predetermined width in a direction of the axis.

This method permits proper and high-speed printing on a three-dimensional printing object without image degradation.

Therefore, an object of the present invention is to perform proper printing on a three-dimensional printing object without image degradation by the use of a multinozzle ejection head.

Another object of the present invention is to facilitate control of the inclination and position of the ejection section for ejecting ink relative to the surface of a three-dimensional object, thereby achieving a high-speed printing operation.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments of the present invention will now be described with reference to the drawings. In the following description, "images" include not only pictures and graphics but also character patterns.

<1. First Preferred Embodiment>

<1-1. Overall Construction of Three-dimensional Object Printing Apparatus>

Figure 1:
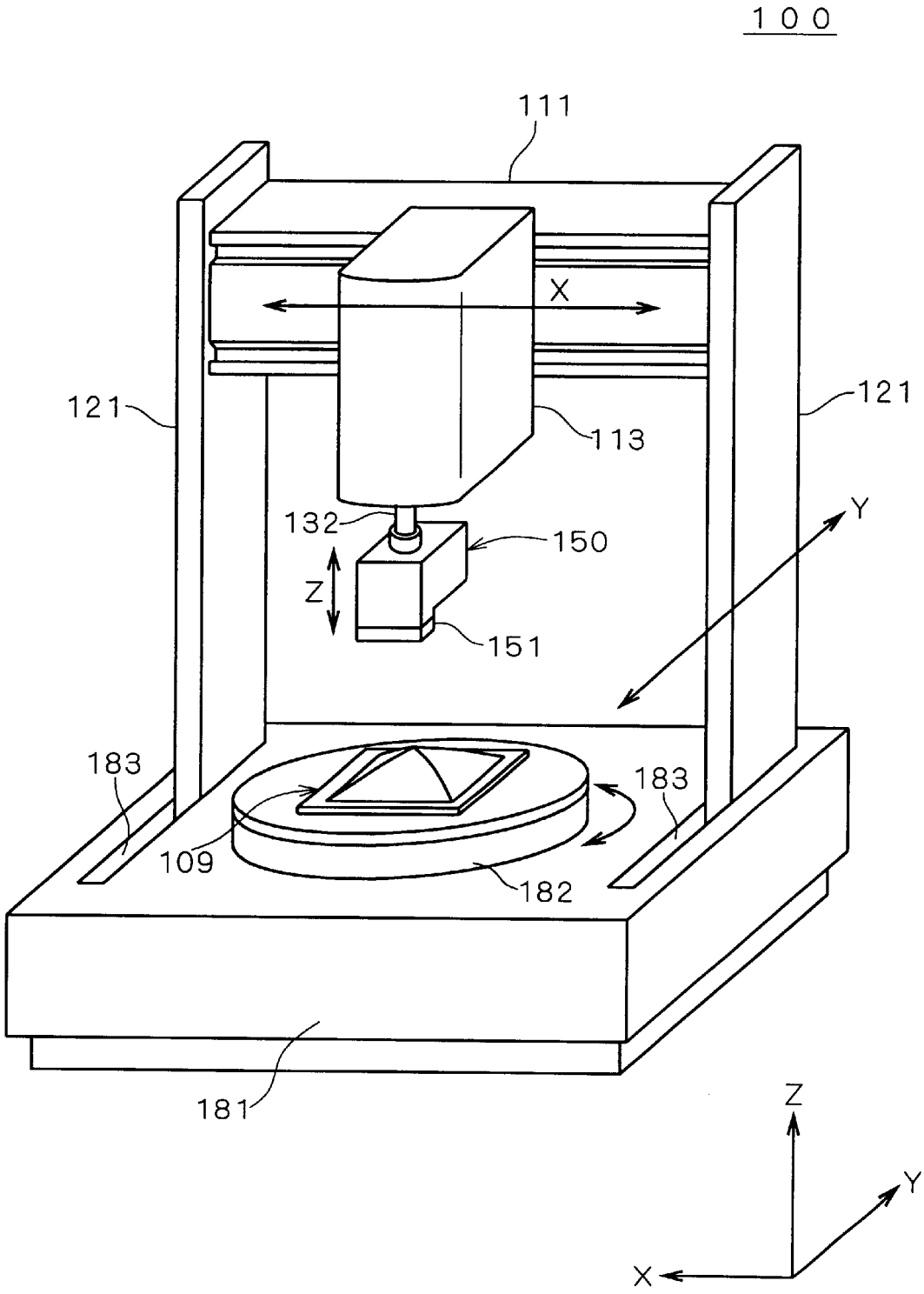
FIG. 1 is an external view of a three-dimensional object printing apparatus according to a first preferred embodiment.

FIG. 1 is an external view of a three-dimensional object printing apparatus 100 according to a first preferred embodiment of the present invention. In this preferred embodiment, three axes orthogonal to one another, namely X, Y, and Z axes, are defined as shown in FIG. 1.

The three-dimensional object printing apparatus 100 comprises a rotatable stage 182 to place a printing object 109 in the center of an upper surface of a base plate 181. The rotatable stage 182 is configured to be rotated in the XY plane by means of a stage rotation driver 170 (cf. FIG. 8) which is located inside the base plate 181, thereby to rotate the printing object 109 mounted on its upper surface. In the upper surface of the base plate 181 on the outer side of the rotatable stage 182, two grooves 183 are formed along a direction of the Y axis to sandwich the rotatable stage 182. In each of the two grooves 183, a stand 121 is provided and can be moved in a direction along the groove 183 (i.e., the Y direction) by means of a sub-scanning direction driver 120 (cf. FIG. 8) which is located inside the base plate 181. A rail 111 is attached to upper portions of the stands 121 along the X direction, and a head holding mechanism 113 is attached to the rail 111. The rail 111 comprises a main scanning direction driver 110 (cf. FIG. 8), by which the head holding mechanism 113 can be moved in a direction along the rail 111 (i.e., the X direction). The head holding mechanism 113 comprises an ejection head vertical driver 135 (cf. FIG. 8).

The head holding mechanism 113 is coupled at its bottom to an ejection head 150 through a vertical shaft 132 which is moved up and down along the Z direction by means of the ejection head vertical driver 135. The ejection head 150 has a nozzle unit 151 to eject printing ink onto the printing object 109 by the ink jet technique or the like. The nozzle unit 151 comprises, in its surface (nozzle surface) opposed to the printing object 109, a plurality of ejection nozzles for ejecting ink. The ejection head 150 comprises an ejection nozzle driver 160 (cf. FIG. 8) for driving each ejection nozzle, the presence of which allows each ejection nozzle to individually eject ink onto the printing object 109. In this preferred embodiment, ink ejection from the ejection nozzles takes place in a downward direction perpendicular to the XY plane.

Figure 2:
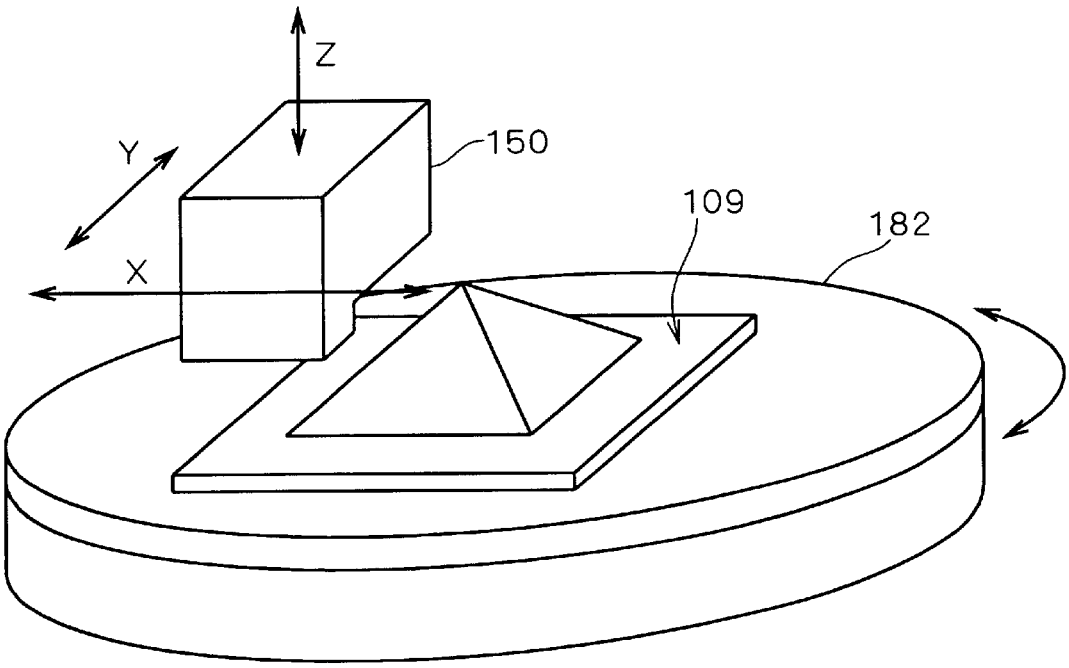
FIG. 2 shows the relative positions of an ejection head and a printing object.

FIG. 2 shows the relative positions of the ejection head 150 and the printing object 109. Assuming that the X direction is the main scanning direction and the Y direction orthogonal to the X direction is the sub-scanning direction, the printing apparatus 100 shown in FIG. 1 performs a printing operation while moving the ejection head 150 relative to the printing object 109. More specifically, the ejection head 150 ejects ink from its ejection nozzles while continuously moving in the main scanning direction X, whereby a single line of printing in the main scanning direction X is performed on a target area of the printing object 109. Upon completion of one printing operation in the main scanning direction X, the ejection head 150 is moved in the sub-scanning direction Y and starts the next printing operation in the main scanning direction X.

During the printing process, it is necessary to have appropriate spacing between the nozzle surface of the ejection head 150, in which a plurality of ejection nozzles are located, and the surface of the printing object 109, and it is also necessary to prevent interference between the ejection head 150 and the printing object 109. For this reason, the ejection head 150 is driven in the Z direction by means of the ejection head vertical driver 135.

As necessary, the relative positions of the ejection head 150 and the printing object 109 can be adjusted by rotation of the rotatable stage 182.

Figure 3A:
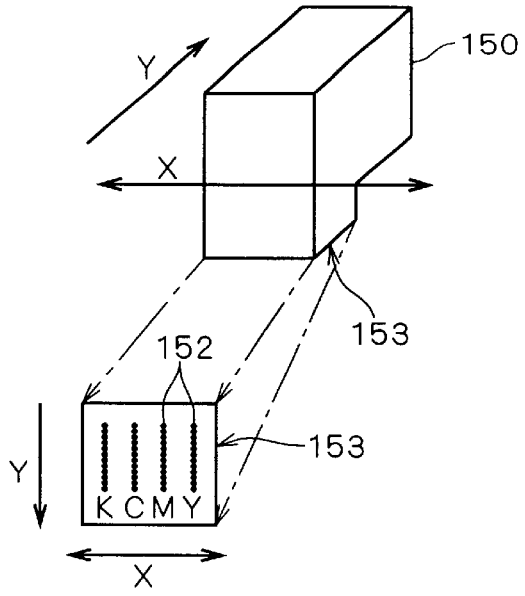
FIGS. 3A and 3B show the configuration of a plurality of ejection nozzles in the ejection head.
Figure 3B:
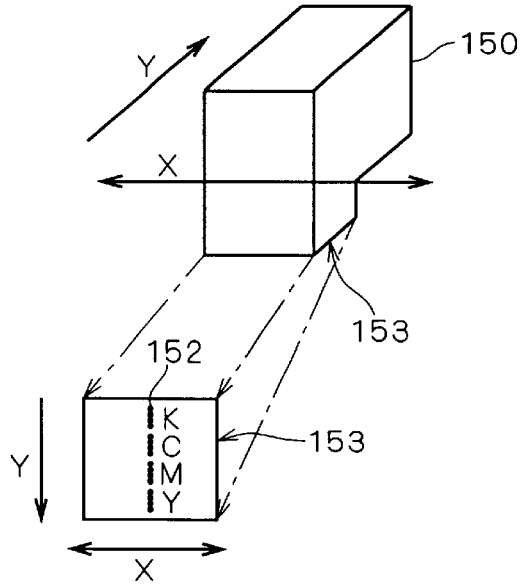

FIGS. 3A and 3B show the configuration of a plurality of ejection nozzles in the ejection head 150. FIG. 3A shows an example of the configuration in which the ejection nozzle position on the main scanning direction X is determined for each of a plurality of color components and a plurality of ejection nozzles 152 of each color component are arranged in the sub-scanning direction Y. FIG. 3B shows another example of the configuration in which the ejection nozzle position on the sub-scanning direction Y is determined for each of a plurality of color components and a plurality of ejection nozzles 152 of each color component are arranged in the sub-scanning direction Y.

In this preferred embodiment, a plurality of color components include four colors, namely Y (yellow), M (magenta), C (cyan), and K (black), which make a basic combination for color printing. The colors, however, are not limited thereto.

When, in the nozzle surface 153 of the ejection head 150, a plurality of color components Y, M, C, K are provided at different positions in the main scanning direction X and a plurality of ejection nozzles 152 of each color component are aligned in the sub-scanning direction Y as shown in FIG. 3A, one scanning in the main scanning direction X makes a single line of color printing on the printing object 109. In this case, however, the ejection nozzles 152 of different color components are located at different positions in the main scanning direction X; therefore, it is necessary to adjust the ejection timing for each color component with respect to the main scanning direction X.

On the other hand, when in the nozzle surface 153, a plurality of color components Y, M, C, K are provided at the same position in the main scanning direction X and a plurality of ejection nozzles 152 of each color component are aligned in the sub-scanning direction Y as shown in FIG. 3B, there is no need to adjust the ejection timing for each color component with respect to the main scanning direction X. However, scanning in the main scanning direction X must be performed at least four times at different positions in the sub-scanning direction Y to make a single line of color printing.

Both the above two configurations allow color printing on the printing object 109 and therefore either of them may be adopted. When the ejection head 150 has such a multinozzle configuration as shown in FIGS. 3A and 3B, color printing in accordance with the width of a nozzle array is achieved with one-time drive of the ejection head 150 in the main scanning direction X (except in cases of the first three main scanning with the configuration of FIG. 3B). This allows more efficient printing than when only a single ejection nozzle is provided for each color component.

In the following description of this preferred embodiment, the ejection head 150 with the multinozzle configuration as shown in FIG. 3A is adopted into the three-dimensional object printing apparatus 100.

<1-2. Principle of Ejection Control>

Now, the principle of printing on a three-dimensional printing object with no image degradation, using a multinozzle ejection head, will be discussed.

Figure 4:
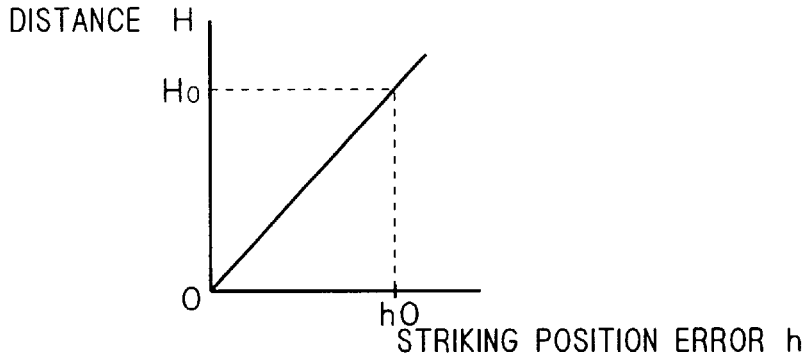
FIG. 4 shows the relationship between a distance H and a striking position error h.

FIG. 4 shows the relationship between the striking position error h by each ejection nozzle and the distance H between the ejection nozzle and the printing object 109. As shown in FIG. 4, if the distance H between each ejection nozzle and the printing object 109 is within a certain range, the striking position error h caused by a deviation in the direction of ink ejection because of nonuniform machining accuracy or nonuniform water repellency of the ejection nozzle is in a proportional relationship with the distance H. That is, the striking position error h increases with the distance H.

As previously described, the quality of printing on the printing object 109 deteriorates with an increase in the striking position error h. To maintain a certain level of print quality, therefore, the striking position error h must be confined within certain limits. In other words, if the required level of print quality is decided, a permissible striking position error h0 can be determined. Then, a permissible distance H0 between the ejection nozzles and the printing object 109 can be derived from the permissible striking position error h0 as shown in FIG. 4.

That is, once the required level of print quality is decided, the permissible distance H0 between the ejection nozzles and the printing object 109 for that level of print quality can be determined.

Figure 5:
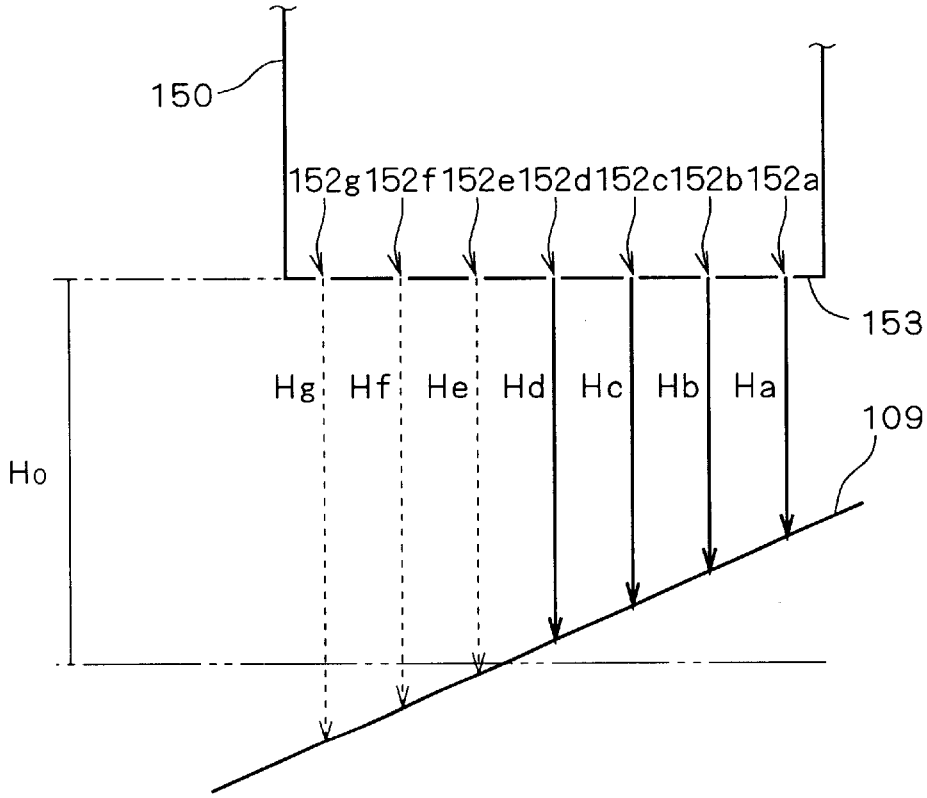
FIG. 5 illustrates limitations on ejection nozzles to be used in a printing operation.

FIG. 5 illustrates limitations on ejection nozzles to be used in a printing operation. As shown in FIG. 5, the nozzle surface 153 of the ejection head 150 has seven ejection nozzles 152*a* to 152*g* formed therein. Once the permissible striking position error h0 is determined by print quality as shown in FIG. 4, the permissible distance H0 can be obtained from the permissible striking position error h0. That is, the required level of print quality is achieved when the distance H between each ejection nozzle and the printing object 109 is smaller than the permissible distance H0, while print quality is below the required level when the distance H is greater than the permissible distance H0. In the example of FIG. 5, the distances H between the ejection nozzles 152*a* to 152*g* and the printing object 109 are obtained: Ha is the distance H from the ejection nozzle 152*a* and Hb to Hg are the distances H from the ejection nozzles 152*b* to 152*g*, respectively. Here, the distance H between each ejection nozzle and the printing object 109 is a distance in the direction of ideal ink ejection from the ejection nozzle, i.e., in the direction of the normal to the nozzle surface 153.

The distance H from each of the ejection nozzles 152*a* to 152*g* is then compared with the permissible distance H0 determined by the required level of image quality. Ink ejection from the ejection nozzle where H>H0 becomes a cause of image degradation and is thus disabled. On the other hand, ink ejection from the ejection nozzle where H<H0 is enabled since the striking position error h by the ejection nozzle is limited to h0 or less and would not reduce the required level of image quality.

On comparison between the distances Ha-Hg from the ejection nozzles 152*a*–152*g* and the permissible distance H0 in the example of FIG. 5, the distances Ha to Hd are smaller than the permissible distance H0 and thus the ejection nozzles 152*a* to 152*d* are enabled for ink ejection, while the distances He to Hg are greater than the permissible distance H0 and thus for the ejection nozzles 152*e* to 152*g* are disabled for ink ejection.

As above described, ejection nozzles to be used in a printing operation are selected out of a plurality of ejection nozzles in a multinozzle ejection head by their respective distances from the printing object, and a printing operation is performed by using those selected ejection nozzles. This allows the striking position errors h of dots formed on the printing object 109 to be confined within specified limits which are determined by the permissible striking position error h0, thereby inhibiting image degradation in the contents of printing on the printing object 109.

<1-3. Ejection Control in Sub-Scanning Direction Y>

Ejection control in the sub-scanning direction Y will now be described concretely.

FIGS. 6A to 6D illustrate ejection control in the sub-scanning direction Y, wherein the paths of ink ejection from ejection nozzles which are enabled for ink ejection (hereinafter referred to as "enabled ejection nozzles") are indicated by the solid lines, and the paths of ink ejection from ejection nozzles which are disabled for ink ejection (hereinafter referred to as "disabled ejection nozzles") are indicated by the broken lines.

In the process of moving the ejection head 150 in the sub-scanning direction Y, the minimum clearance (spacing) between the ejection head 150 and the printing object 109 is maintained at a predetermined value R0 to avoid interference therebetween. Here, the minimum clearance is the minimum spacing between an area of the ejection head 150 opposite the printing object 109 and the surface of the printing object 109. To maintain the minimum clearance at the predetermined value R0, the ejection head vertical driver 135 is driven in response to a scanning position of the ejection head 150 thereby to adjust the vertical position of the ejection head 150 in the Z direction.

Figure 6A:
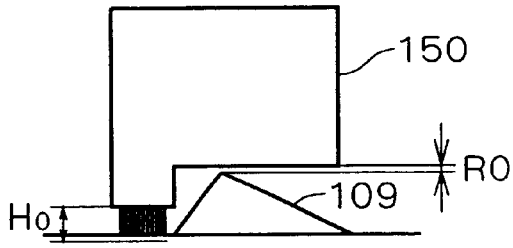
FIGS. 6A to 6D illustrate ejection control with respect to a sub-scanning direction.

FIG. 6A illustrates printing on a horizontal surface of the printing object 109. When the distance H between each ejection nozzle and the printing object 109 is obtained with the minimum clearance of R0 between the ejection head 150 and the printing object 109, all ejection nozzles satisfy the inequality H≦H0. Thus, ink is ejected from all the ejection nozzles, which achieves efficient printing.

Figure 6B:
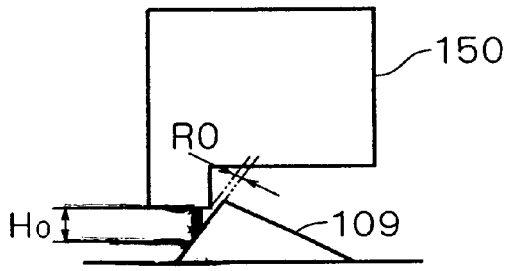

FIG. 6B illustrates printing on a steeply inclined surface of the printing object 109. When the distance H between each ejection nozzle and the printing object 109 is obtained with the minimum clearance of R0 between the ejection head 150 and the printing object 109, ejection nozzles located above the upper portion of the inclined surface satisfy the inequality H≦H0 while ejection nozzles located above the lower portion of the inclined surface satisfy the inequality H>H0. Thus, ink ejection from the ejection nozzles located above the lower portion of the inclined surface is disabled and a printing operation is performed using only the ejection nozzles located above the upper portion of the inclined surface.

Figure 6C:
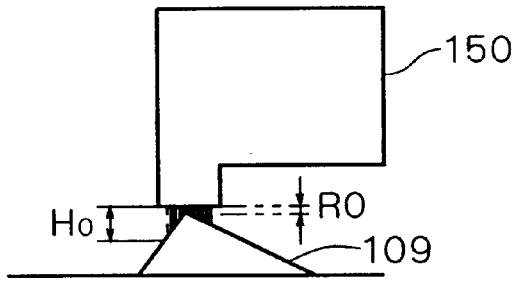

FIG. 6C illustrates printing on a top portion of the printing object 109. When the distance H between each ejection nozzle and the printing object 109 is obtained with the minimum clearance of R0 between the ejection head 150 and the object 109, ejection nozzles located around the top portion satisfy the inequality H≦H0 while some ejection nozzles located above the steeply inclined surface satisfy the inequality H>H0. Thus, ink ejection from the ejection nozzles located above the inclined surface is disabled and a printing operation is performed using only the ejection nozzles located around the top portion.

Figure 6D:
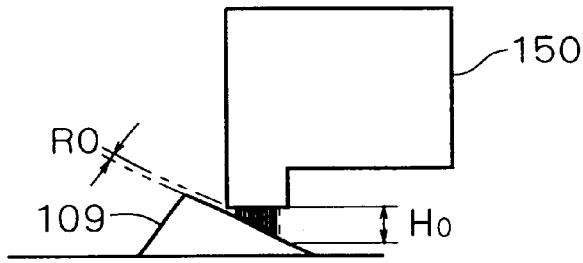

FIG. 6D illustrates printing on a gently inclined surface of the printing object 109. When the distance H between each ejection nozzle and the printing object 109 is obtained with the minimum clearance of R0 between the ejection head 150 and the object 109, ejection nozzles located above the upper portion of the inclined surface satisfy the inequality H≦H0 while ejection nozzles located above the lower portion of the inclined surface satisfy the inequality H>H0. Thus, ink ejection from the ejection nozzles located above the lower portion of the inclined surface is disabled and a printing operation is performed using only the ejection nozzles located above the upper portion of the inclined surface. In printing on the gently inclined surface, the number of ejection nozzles disabled for ink ejection is smaller than that in printing on the steeply inclined surface; therefore, more efficient printing is performed.

As above described, when the ejection head 150 is moved in the sub-scanning direction Y during a printing operation, the distance H in response to the position of each ejection nozzle is obtained and printing is performed using only the ejection nozzles whose distances H are within specified limits determined by the permissible distance H0. Such a configuration inhibits image degradation in the contents of printing.

In a printing operation performed in the sub-scanning direction Y as shown in FIG. 6A to 6D, when the configuration of ejection nozzles in the ejection head 150 is as shown in FIG. 3A, proper ink ejection is possible for every color component. In the configuration as shown in FIG. 3B, however, since the ejection nozzles of each color component are aligned in the sub-scanning direction Y and in the case of FIG. 6B, for example, ink ejection of only a Y color component (yellow) is enabled while ink ejection of the other color components, namely C (cyan), M (magenta), and K (black), is disabled. In this case, proper color printing cannot be performed on a steeply inclined surface of the printing object 109, but in such a case the rotatable stage 182 is rotated through a predetermined angle (e.g., 90°) in accordance with the shape of the printing object 109 thereby to adjust the relative positions of the ejection head 150 and the printing object 109.

The adjustment of the relative positions of the ejection head 150 and the printing object 109 must be made to increase the number of ejection nozzles enabled for ink ejection. In the above case of FIG. 6B, for example, position adjustments are made to enable ink ejection of all the color components, although before the adjustments, ink ejection of only the Y color component (yellow) was enabled. In this fashion, the number of ejection nozzles enabled for ink ejection can be increased by adjusting the relative positions of the ejection head 150 and the printing object 109, whereby proper and high-speed color printing becomes possible.

<1-4. Ejection Control in Main Scanning Direction X>

Next, ejection control in the main scanning direction X will be described concretely.

FIGS. 7A to 7D illustrate ejection control in the main scanning direction X, wherein the paths of ink ejection from enabled ejection nozzles are indicated by the solid lines and the paths of ink ejection from disabled ejection nozzles are indicated by the broken lines.

In the process of moving the ejection head 150 in the main scanning direction X, the minimum clearance between the ejection head 150 and the printing object 109 is maintained at a predetermined value R0 to avoid interference therebetween. Also in this case, the ejection head vertical driver 135 is driven as necessary to adjust the vertical position of the ejection head 150 in the Z direction.

Figure 7A:
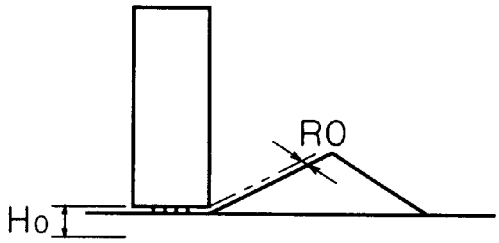
FIGS. 7A to 7D illustrate ejection control with respect to a main scanning direction.

FIG. 7A illustrates printing on a horizontal surface of the printing object 109. When the distance H between each ejection nozzle and the printing object 109 is obtained with the minimum clearance of R0 between the ejection head 150 and the printing object 109, all the ejection nozzles satisfy the inequality H≦H0. Thus, ink is ejected from all the ejection nozzles, which achieves efficient printing.

Figure 7B:
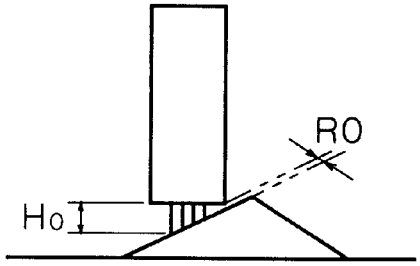

FIG. 7B illustrates printing on a gently inclined surface of the printing object 109. When the distance H between each ejection nozzle and the printing object 109 is obtained with the minimum clearance of R0 between the ejection head 150 and the printing object 109, all the ejection nozzles satisfy the inequality H≦H. Thus, ink is ejected from all the ejection nozzles, which achieves efficient printing.

Figure 7C:
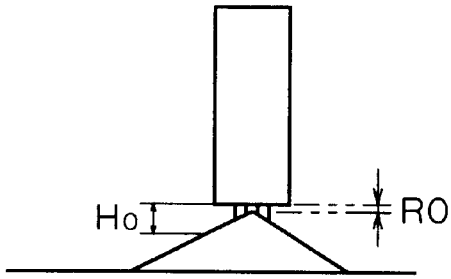

FIG. 7C illustrates printing on a top portion of the printing object 109. When the distance H between each ejection nozzle and the printing object 109 is obtained with the minimum clearance of R0 between the ejection head 150 and the printing object 109, all the ejection nozzles satisfy the inequality H≦H0. Thus, ink is ejected from all the ejection nozzles, which achieves efficient printing.

Figure 7D:
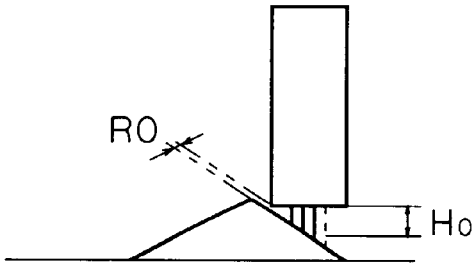

FIG. 7D illustrates printing on a steeply inclined surface of the printing object 109. When the distance H between each ejection nozzle and the printing object 109 is obtained with the minimum clearance of R0 between the ejection head 150 and the printing object 109, ejection nozzles located above the upper portion of the inclined surface satisfy the inequality H≦H0 while ejection nozzles located above the lower portion of the inclined surface satisfy the inequality H>H0. Thus, ink ejection from the ejection nozzles located above the lower portion of the inclined surface is disabled and a printing operation is performed using only the ejection nozzles located above the upper portion of the inclined surface.

When the configuration of ejection nozzles is such that a plurality of color components are aligned in the main scanning direction X as shown in FIG. 3A and printing is performed on a steeply inclined surface as shown in FIG. 7B, all ejection nozzles of the Y color component (yellow) are disabled for ink ejection. Thus, yellow ink cannot be ejected on the lower portion of the inclined surface. This makes proper color printing impossible.

In such a case, the rotatable stage 182 is, as above described, rotated through a predetermined angle to adjust the relative positions of the ejection head 150 and the printing object 109 so that ink of all the color components can be ejected. By adjusting the relative positions of the ejection head 150 and the printing object 109, the number of ejection nozzles enabled for ink ejection can be increased. This permits proper and high-speed color printing.

If ejection nozzles are selected as above described, print spans vary according to the inclination of a printing object. For printing with no clearance, therefore, the amount of scanning should be changed according to the print span.

<1-5. Control Mechanism of Three-dimensional Object Printing Apparatus 100>

A control mechanism of the three-dimensional object printing apparatus 100 will now be described.

Figure 8:
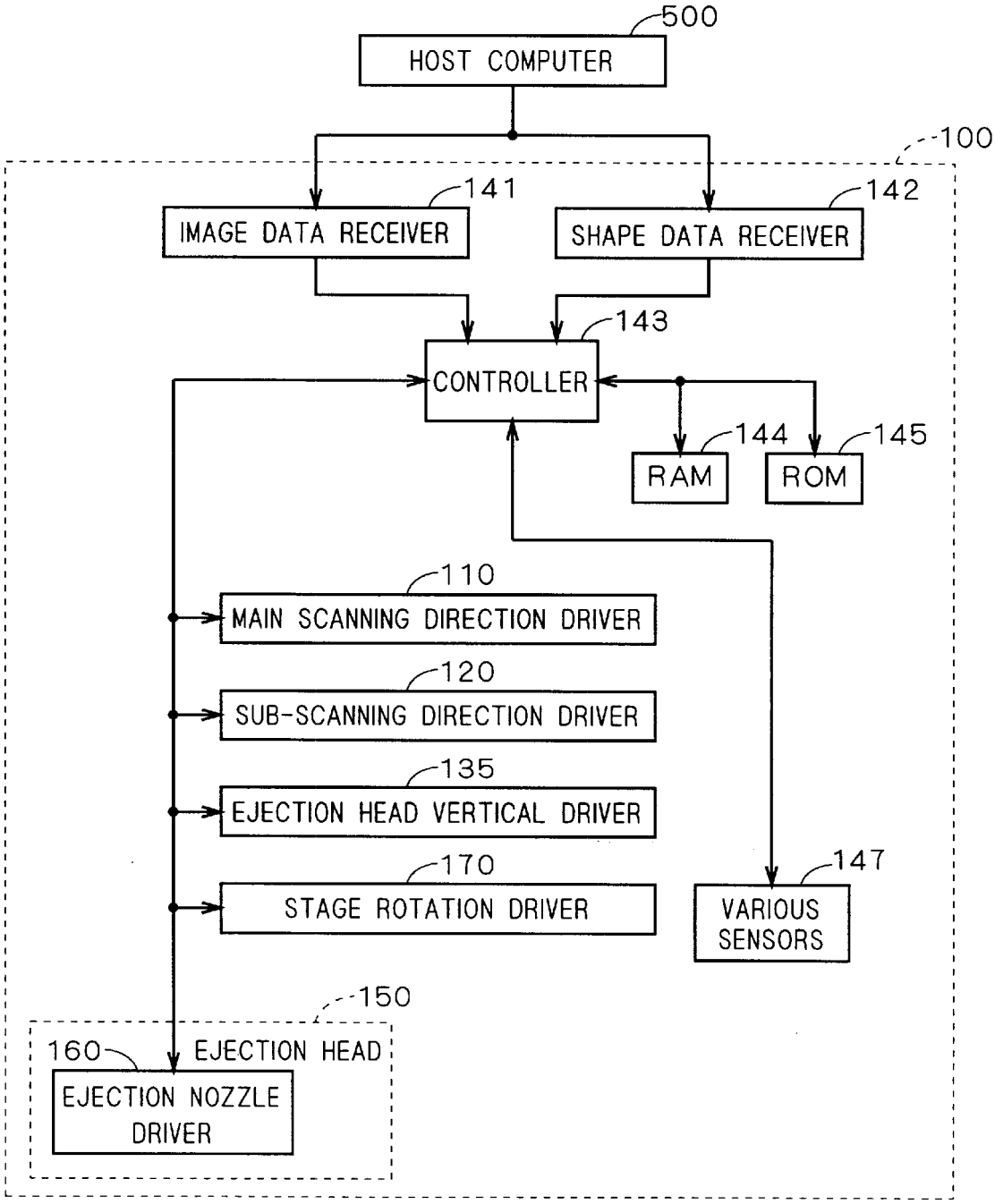
FIG. 8 is a block diagram of a control mechanism of the printing apparatus.

FIG. 8 is a block diagram of the control mechanism of the three-dimensional object printing apparatus 100. As shown in FIG. 8, the apparatus 100 comprises an image data receiver 141, a shape data receiver 142, a controller 143, a RAM 144, a ROM 145, the main scanning direction driver 110, the sub-scanning direction driver 120, the ejection head vertical driver 135, the stage rotation driver 170, various sensors 147, and the ejection nozzle driver 160. The image data receiver 141 receives image data, which represents the contents of printing on the printing object 109 in the form of an image, from a host computer 500 connected to the outside. The shape data receiver 142 receives shape data about the surface shape of the printing object 109 from the host computer 500.

The controller 143 controls the main scanning direction driver 110, the sub-scanning direction driver 120, the ejection head vertical driver 135, the stage rotation driver 170, and the ejection nozzle driver 160. According to the shape data about the printing object 109, the controller 143 also obtains the distances H between a plurality of ejection nozzles and the printing object 109 at each scanning position of the ejection head 150 when the ejection head 150 scans the printing object 109 with the minimum clearance of R0. Then, ejection nozzles to be used in a printing operation at each scanning position are previously determined on the basis of the distance H from each of the ejection nozzles. Once the actual printing operation starts, the controller 143, by controlling each of the drivers, causes the ejection head 150 to scan the printing object 109 with the minimum clearance being maintained at a predetermined value R0 and transmits a predetermined ejection timing signal to the ejection nozzle driver 160 thereby to operate ejection nozzles enabled for ink ejection at each scanning position.

The RAM 144 is memory for storing image and shape data received from the host computer 500 and print control data previously generated by the controller 143. The ROM 145 is memory for storing a program for implementing the procedure of a printing operation (e.g., a flow chart of FIG. 9 which will be described later) performed by the controller 143.

The main scanning direction driver 110 is located inside the rail 111 (cf. FIG. 1). It is capable of moving the head holding mechanism 113 along the rail 111 by driving a predetermined motor and the like on an operating command from the controller 143, whereby the ejection head 150 is moved in the main scanning direction X.

The sub-scanning direction driver 120 is located inside the base plate 181 (cf. FIG. 1). It is capable of moving the stands 121 along the grooves 183, which are formed along the Y direction, by driving a predetermined motor and the like on an operating command from the controller 143, whereby the ejection head 150 is moved in the sub-scanning direction Y.

The ejection-head vertical driver 135, which is located inside the head holding mechanism 113, moves the ejection head 150 up and down in the Z direction on an operating command from the controller 143.

The various sensors 147 are detectors for detecting home positions or the like of the operating sections such as the main scanning direction driver 110 and detecting the ink level and the like in the ejection head 150. These detectors give precision to the operation in each direction and give instructions when the ink tanks and the like need changing.

The ejection nozzle driver 160 is located inside the ejection head 150 and controls ink ejection from ejection nozzles in the ejection head 150 in response to the ejection timing signal from the controller 143.

The three-dimensional object printing apparatus 100 with the aforementioned functional configuration, especially by using the control function of the controller 143, can prevent image degradation in the contents of printing on the three-dimensional printing object 109.

<1-6. Printing Operation of Three-dimensional Object Printing Apparatus 100>

The actual printing operation performed by the three-dimensional printing apparatus 100 on the three-dimensional printing object 109 will now be described by way of example.

Figure 9:
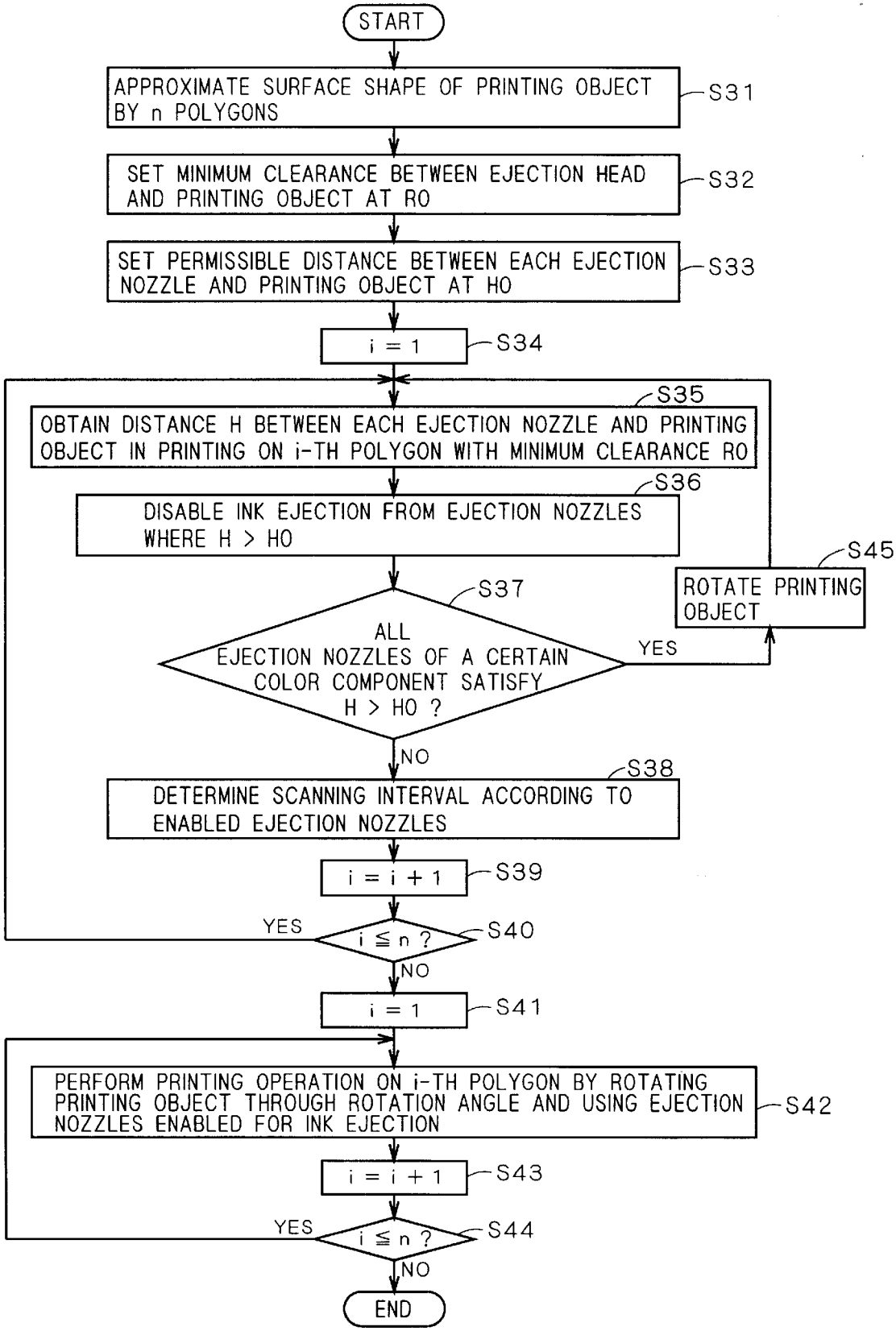
FIG. 9 is a flow chart showing an example of the overall operation of the printing apparatus.

FIG. 9 is a flow chart showing an example of the overall operation of the three-dimensional object printing apparatus 100. Mainly, an operating procedure by the controller 143 in the aforementioned configuration is shown.

In step S31, a printing surface of the printing object 109 is approximated by n polygonal faces (where n is any integer). More specifically, upon receipt of shape data about the printing object 109 from the host computer 500, the controller 143 processes that data, whereby even when the printing object 109 has only smooth irregularities or the like in the surface, the surface shape of the printing object 109 is represented as a set of a plurality of polygonal faces.

In step S32, the minimum clearance between the ejection head 150 and the printing object 109 is set at a predetermined value R0. This predetermined value R0 is peculiar to the three-dimensional object printing apparatus 100 and is set at the minimum value required to completely avoid interference between the ejection head 150 and the printing object 109, in consideration of the accuracy of the mechanism sections, backlash, and the like.

In step S33, the permissible distance H0 between each of a plurality of ejection nozzles in the ejection head 150 and the printing object 109 is determined. This permissible distance H0 varies according to the user-designated level of image quality for the contents of printing.

In step S34, a polygon parameter i is initialized to 1. In step S35, the distance H between each ejection nozzle and the printing object 109 at each scanning position during printing of the i-th polygon with the minimum clearance R0 is obtained according to the shape data.

In step S36, the distances H from the plurality of ejection nozzles are compared respectively with the permissible distance H0. Ejection nozzles which satisfy the inequality H>H0 are disabled for ink ejection at the scanning position. On the other hand, the other ejection nozzles are enabled for ink ejection at that scanning position.

In step S37, whether or not all ejection nozzles of a certain color component out of a plurality of color components satisfy the inequality H>H0 is determined. That is, if all ejection nozzles of at least one color component are disabled for ink ejection, proper color printing becomes impossible; therefore, it is determined whether or not such circumstances arise at each scanning position in printing of the i-th polygon. If YES, the process goes to step S45. If NO, the process goes to step S38.

In step S45, shape data about the printing object 109, which is assumed to be rotated through a predetermined angle in the XY plane, is generated for subsequent processing of steps S35 to S37, and the process returns to step S35. In steps S35 to S37, with the printing object 109 rotated through a predetermined angle, each ejection nozzle is either enabled or disabled for ink ejection and then it is determined whether or not all ejection nozzles of at least one color component are disabled for ink ejection.

After repeated processing of steps S35 to S37 and S45, all the color components can have ejection nozzles enabled for ink ejection. This permits proper color printing and step S37 goes to NO.

In step S38, an interval of scanning is determined from the ejection nozzles to be used. By determining the scanning interval can be performed without clearance regardless of variations in the inclination of a printing object.

Based on the scanning interval, the information indicating that each ejection nozzle is either enabled or disabled for ink ejection at each scanning position, and the information about the angle of rotation of the printing object 109, print control data for printing of the i-th polygon are temporarily stored in the RAM 144.

In step S39, the polygon parameter i is incremented by 1 and the process goes to step S40. In step S40, whether print control data for all the n polygons have been generated or not is determined. If the processing for all the polygons has been completed, the process goes to step S41. Otherwise, the process returns to step S35 to generate print control data for the next polygon.

Next, processing of steps S41 to S44 is performed for printing on each polygon.

In step S41, the polygon parameter i is initialized to 1. In step S42, according to print control data for the i-th polygon fetched from the RAM 144, the controller 143 operates the rotatable stage 182 to rotate the printing object 109 through the predetermined rotation angle and controls the actual printing operation to be performed using only ejection nozzles enabled for ink ejection. After the printing operation on that polygon is completed, the polygon parameter i is incremented by 1 in step S43 and the process goes to step S44.

In step S44, whether or not the printing operations on all the n polygons are completed is determined. If all the operations are completed, the printing operation on the printing object 109 is completed. Otherwise, the process returns to step S42 and starts a printing operation on the next polygon.

In the printing operation of step S42, ejection nozzles whose distances H from the printing object 109 are greater than the permissible distance H0 are disabled for ink ejection. Therefore, the striking position errors h of dots formed on the surface of the printing object 109 can be limited to the permissible striking position error h0 or less, whereby the user-desired level of print quality is achieved.

This completes the operation of the three-dimensional object printing apparatus 100, whereby printing in conformity with image data representing the contents of printing can be performed on the printing object 109. While the aforementioned printing operation can achieve any user-designated level of print quality, the apparatus 100 may be configured to have three modes of operation which can be designated by the user at the time of execution.

For instance, three modes of operation, namely a high-quality/low-speed mode, a medium-quality/medium-speed mode, and a low-quality/high-speed mode, are provided.

The medium-quality/medium-speed mode is an operation mode in which the permissible distance H0 between each ejection nozzle and a printing object is set at a predetermined value to achieve a certain level of print quality and a printing operation is performed while imposing limitations responsive to the above permissible distance H0 on ejection nozzles to be used.

The high-quality/low-speed mode is an operation mode in which, by setting the permissible distance H0 smaller than the predetermined value in the medium-quality/medium-speed mode, printing is performed with higher quality than in the medium-quality/medium-speed mode. The smaller permissible distance H0 increases the number of ejection nozzles disabled for ink ejection and thus required print time is longer than in the medium-quality/medium-speed mode. In this operation mode, scanning speed in the main scanning direction X can be reduced as necessary. More specifically, since there are variations in the speed of ink droplet ejection from each ejection nozzle, the movement of the ejection head 150 in the main scanning direction X causes deviations in the striking positions of ink droplets, but such deviations in the striking positions can be minimized by reducing the scanning speed.

The low-quality/high-speed mode is an operation mode in which, by setting the permissible distance H0 greater than the predetermined value in the medium-quality/medium-speed mode (i.e., to the maximum value), the number of ejection nozzles disabled for ink ejection is reduced and thereby high-speed printing becomes possible. In some cases in this operation mode, no ejection nozzle may be disabled for ink ejection during overall printing on the printing object 109. In such cases, a printing operation is the most efficient but is of the lowest print quality.

A user can select any one of the above three operation modes in consideration of the balance between print quality and print speed.

Important part of image data representing the contents of printing is edge portions of the image. When receiving image data, the controller 143 may perform image processing on the image data and extract edge portions (e.g., a contour, eyes, and mouth for a face image) from the whole image which is the contents of printing, then automatically switch the operation mode from low-quality/high-speed or medium-quality/medium-speed to high-quality/low-speed for printing of such edge portions. In such a form of operation, only the edge portions of the image which require the highest degree of accuracy of dot striking positions can be printed in the high-quality mode and the other portions of the image can be printed with relative efficiency. This improves print quality efficiently without a considerable reduction in print speed. Here, portions of the image to be printed in the high-quality/low-speed mode are not limited to the edge portions but may be any other specific portion. By so doing, any specific portion of the image can be printed with high quality.

Further, when printing a portion such as a V-shaped groove in the surface of the printing object 109 in the high-quality/low-speed mode, high-quality printing may be difficult because the distances H between all the ejection nozzles and the printing object 109 are greater than the permissible distance H0. In such a case, only a single ejection nozzle may be selected for each of the Y, M, C, and K color components and used in a printing operation, by which high-quality printing is made possible.

Now focusing attention on one ejection nozzle, a deviation from the ejection nozzle in the direction of ink ejection is constant. From this, if one ejection nozzle is selected for each of the Y, M, C, and K color components and data about deviations in the directions of ink ejection from those ejection nozzles are previously obtained, it would be possible to compute the amount of deviation in the ink striking position responsive to the distance H between each ejection nozzle and the printing object 109. In the case where there are problems in performing printing in high-quality/low-speed mode, therefore, a deviation in the striking position of an ink droplet from a single ejection nozzle should be predicted for each of the Y, M, C, and K color components and then the results of prediction should be fed back to the print control data. This makes possible accurate ink ejection from a single ejection nozzle for each color component, thereby achieving high-quality printing. In this case, however, a printing operation is performed using only a single ejection nozzle for each color component; therefore, required print time is the longest.

<1-7. Other Examples of Printing Operation>

The aforementioned method of approximating the surface shape of the three-dimensional printing object 109 by a plurality of polygonal faces and performing printing on those polygonal areas in sequence is a reliable method for printing on the printing object 109. However, it requires the adjustment of the relative positions of the ejection head 150 and the printing object 109 for each polygon. For more efficient printing, therefore, a printing operation with no polygon-by-polygon processing is desired.

For example, if the ejection head 150 is prevented from using ejection nozzles which have ever been disabled for ink ejection during the process of scanning the surface of the printing object 109, printing can be performed with a constant print span on the printing object 109.

Figure 10A:
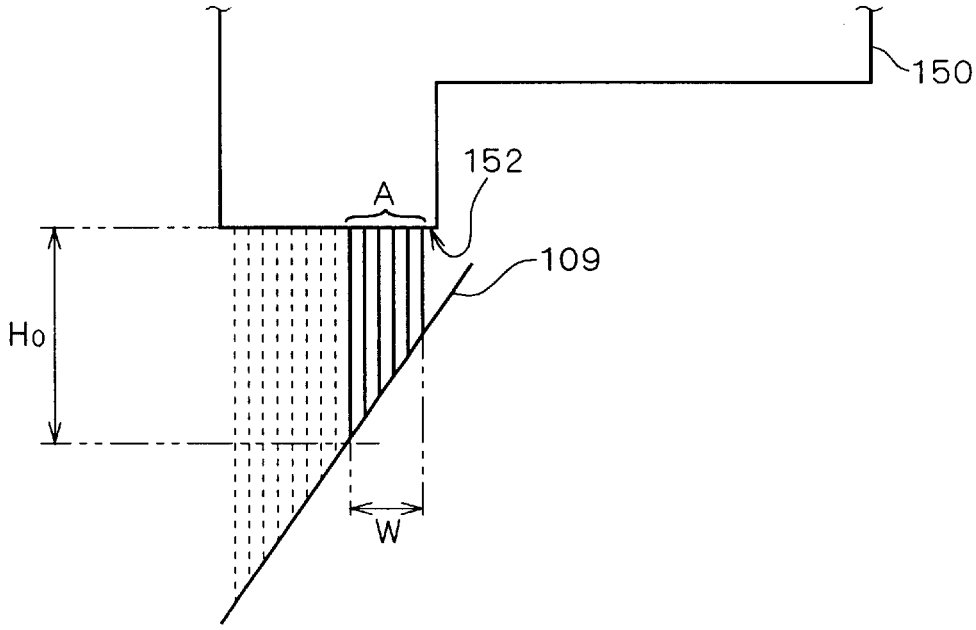
FIGS. 10A and 10B show a form of printing with a constant print span.
Figure 10B:
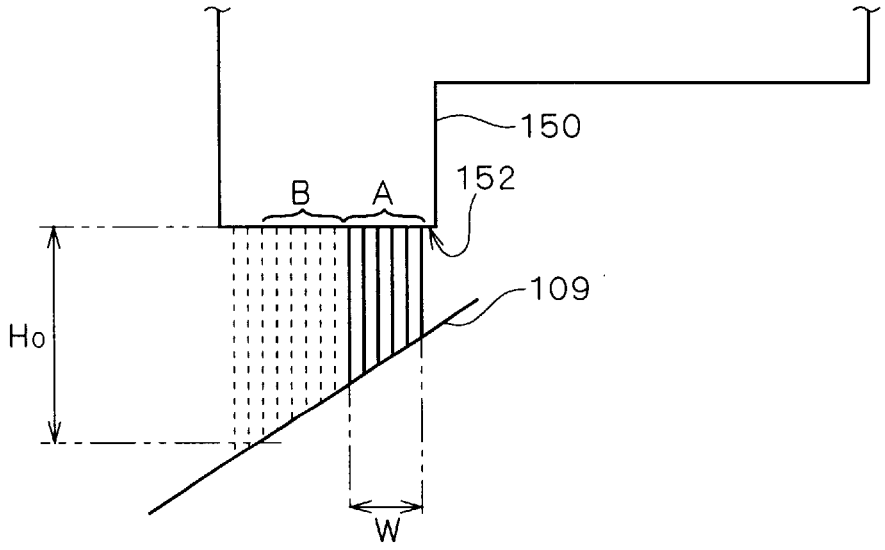

FIGS. 10A and 10B show a form of printing with a constant print span. FIG. 10A illustrates ink ejection on the most steeply inclined surface in a main scanning area at a certain sub-scanning position, and FIG. 10B illustrates ink ejection on a gently inclined surface. Where the inclination angles of the print area of the object 109 with respect to the nozzle surface 153 are different as shown in FIGS. 10A and 10B, every ejection nozzle whose distance H is not more than the permissible distance H0 shall be enabled for ink ejection. For the steeply inclined surface in FIG. 10A, ejection nozzles included in an area A are enabled for ink ejection. For the gently inclined surface in FIG. 10B, ejection nozzles included in areas A and B are enabled for ink ejection. That is, print spans in printing on the printing object 109 are not constant.

In this case, if the printing operation in the main scanning direction X is repeatedly performed with the movement in the sub-scanning direction Y, clearance would occur in the print area because of a short print span in printing on the steeply inclined surface.

For this reason, only the ejection nozzles included in the area A are used for printing with a print span W on both the most steeply inclined surface as shown FIG. 10A and the gently inclined surface as shown in FIG. 10B in the main scanning area at a certain sub-scanning position. This achieves printing with the constant print span W.

As a result, proper and efficient printing with no clearance in the print area becomes possible.

Figure 11A:
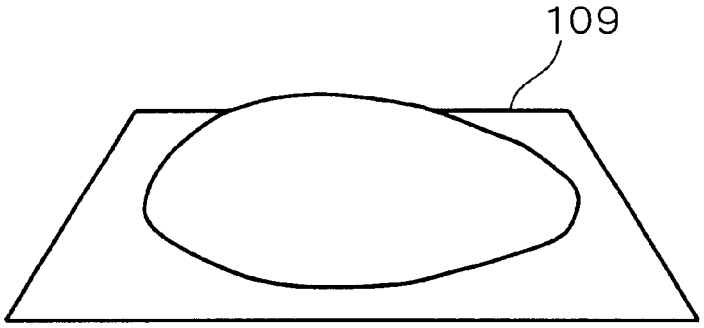
FIGS. 11A to 11C show a form of printing performed in strips with a constant print span in the main scanning direction.
Figure 11B:
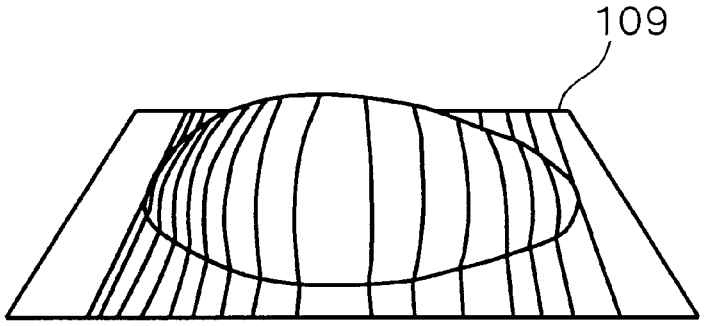
Figure 11C:
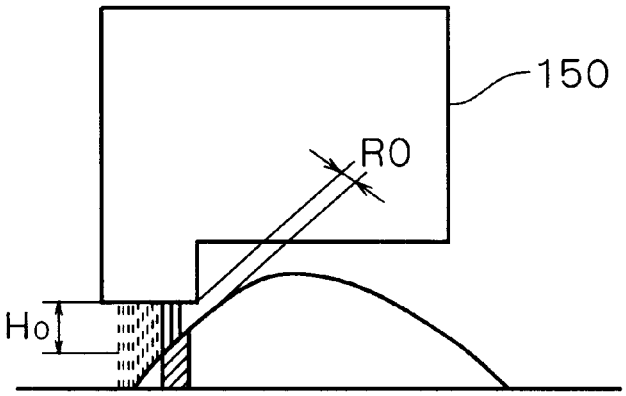

FIGS. 11A to 11C show a form of printing performed in strips with a constant print span in the main scanning direction X. Upon receipt of shape data about the surface shape of the printing object 109 as shown in FIG. 11A, the controller 143 generates print control data for enabling printing with a constant print span when the ejection head 150 is continuously moved in the main scanning direction X as shown in FIG. 11B. At this time, ejection nozzles which have ever been disabled for ink ejection during the process of moving the ejection head 150 in the main scanning direction X, are disabled for ink ejection during the main scanning. By controlling each driver as shown in FIG. 11C, the controller 143 can perform a printing operation with a constant print span in the main scanning direction X. More specifically, when the ejection head 150 performs scanning in the main scanning direction X, a printing operation is performed with reference to the shortest print span. In such a form of operation, a printing operation in the main scanning direction X can be performed by only updating the sub-scanning position and there is no need of polygon-by-polygon-processing. This permits high-speed printing.

FIGS. 12 and 13A to 13D show a form of printing performed with a constant print span at the same level of a printing object.

Figure 12:
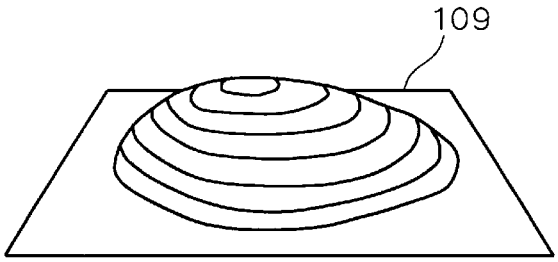
FIGS. 12 and 13A to 13D illustrate a form of printing performed with a constant print span at the same level of a printing object.

Upon receipt of shape data about the surface shape of the printing object 109, the controller 143 generates print control data for enabling printing with a constant print span when the ejection head 150 scans the surface of the printing object 109 at a certain level of the object 109 as shown in FIG. 12. More specifically, the controller 143, as avoiding interference between the ejection head 150 and the printing object 109, divides the surface shape of the printing object 109 by a plurality of contour lines in consideration of the permissible distance H0.

At this time, the increment of elevation between two contour lines (i.e., a "difference of altitude") is set to a width that can be printed with one scan using ejection nozzles whose distances H are not more than the permissible distance H0. In other words, the smallest width of elevation that can be printed with one scan in the direction of contour lines is determined as a contour interval. When the ejection head 150 is positioned in a certain vertical position, a fixed width of printing is performed on the area between two contour lines corresponding to the vertical position of the ejection head 150.

Figure 13A:
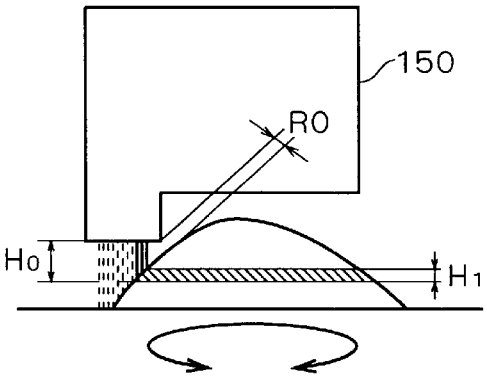
Figure 13B:
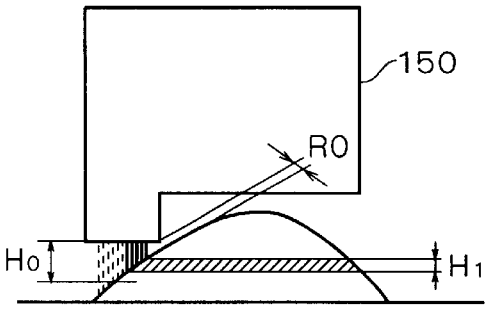

The actual printing operation is performed for example as shown in FIGS. 13A to 13D. In printing on a steeply inclined surface of the printing object 109 as shown in FIG. 13A, ink is ejected from every ejection nozzle whose distance H is not more than the permissible distance H0 and thus printing is performed with a width Hi. Then, the printing object 109 is rotated by rotation of the rotatable stage 182 while maintaining the vertical position of the ejection head 150. Thereby, next printing is performed with the width Hi on a gently inclined surface of the printing object 109 as shown in FIG. 13B.

Figure 13C:
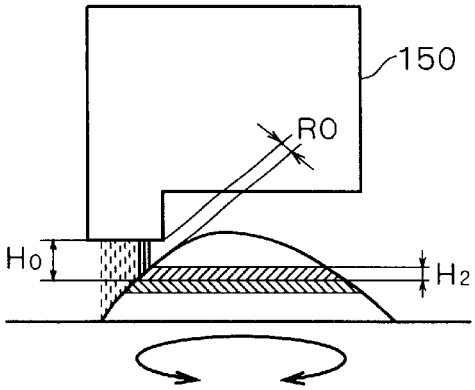
Figure 13D:
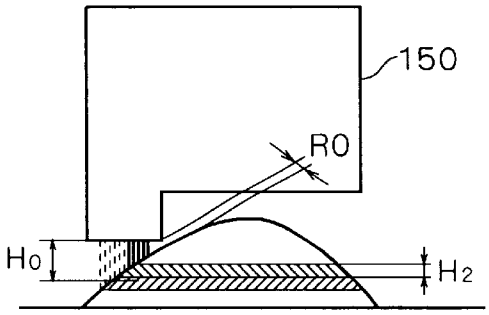

After that, the ejection head 150 is elevated. In printing on the steeply inclined surface of the printing object 109 as shown in FIG. 13C, ink is ejected from every ejection nozzle whose distance H is not more than the permissible distance H0 and thus printing is performed with a width of elevation H2. Then, the printing object 109 is rotated by rotation of the rotatable stage 182 while maintaining the vertical position of the ejection head 150. Thereby, next printing is performed with the width H2 on the gently inclined plane of the printing object 109 as shown in FIG. 13D.

In this form of operation, a form of scanning is not the regular one performed along the main scanning direction X and the sub-scanning direction Y. Instead, ejection nozzles which allow a fixed width of printing are selected out of a plurality of ejection nozzles on the basis of their respective distances H at each scanning position in the process of scanning the printing object 109 with the ejection head 150 in a certain vertical position. Then, a printing operation is performed in that vertical position of the ejection head 150. Such a form of operation does not require polygon-by-polygon processing, thereby permitting high-speed printing.

<1-8. Modifications>

So far, the first preferred embodiment of the present invention has been discussed, but it is to be understood that the present invention is not limited thereto.

For example, the configurations of the drivers such as the main scanning direction driver 110 are not limited to those described above. Those drivers may be of any configuration as long as the ejection head 150 is configured to be movable relative to the printing object 109.

In the aforementioned preferred embodiment, ejection nozzles to be used for printing are selected on the basis of their respective distances from the printing object, but the following configuration can also be adopted:

That is, ejection nozzles to be used and whether the rotation of the ejection head is necessary or not are previously determined by the shape of a printing object (the direction and angle of inclination) and stored for example in the form of a table. Then, the direction and angle of inclination of each polygon are obtained and used for reference to the table, whereby ejection nozzles to be used and the rotation of the ejection head are determined.

<2. Second Preferred Embodiment>

<2-1. Construction of Apparatus>

Figure 14:
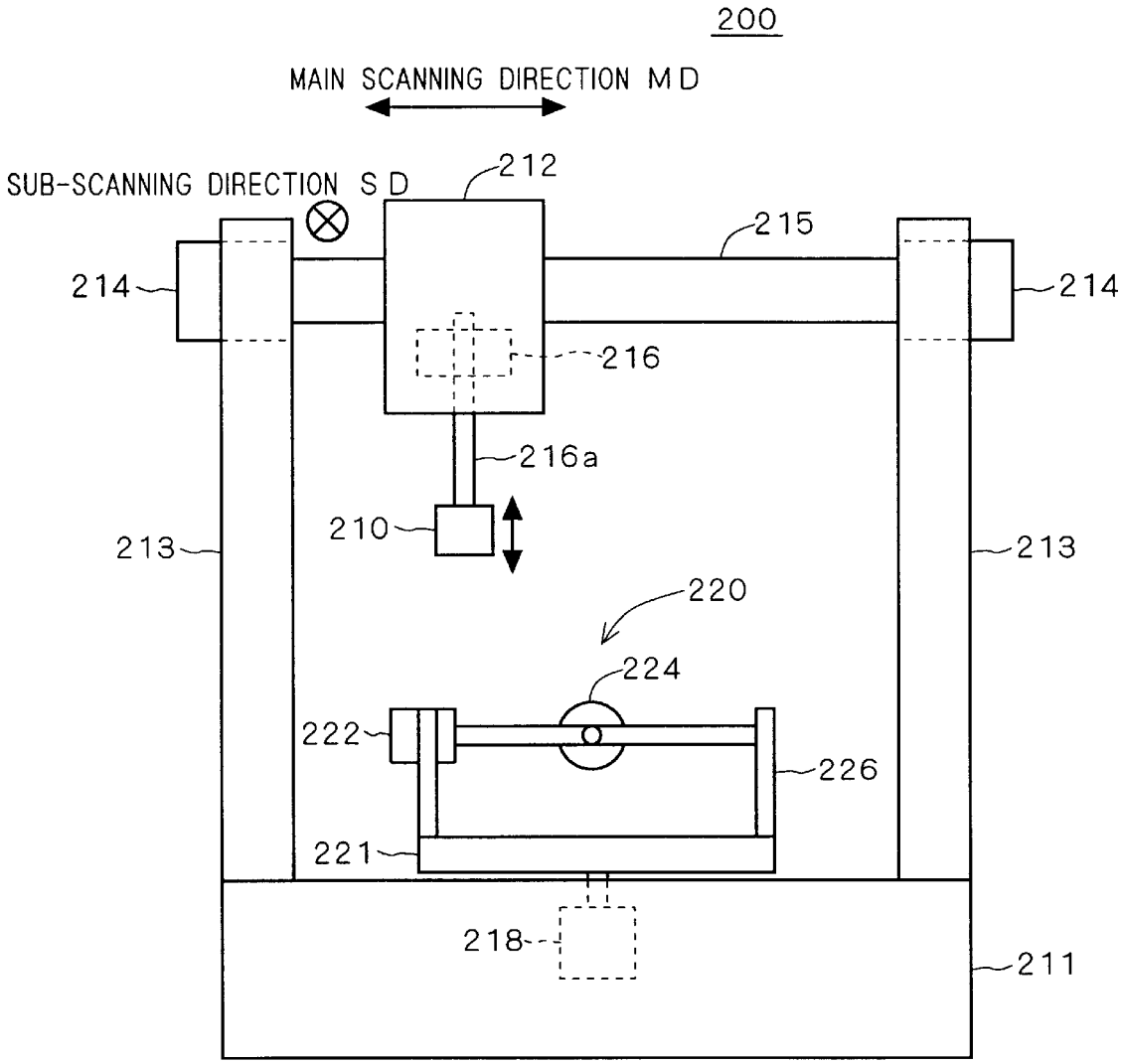
FIG. 14 is a schematic diagram of a three-dimensional object printing apparatus when viewed from the front according to a second preferred embodiment.
Figure 15:
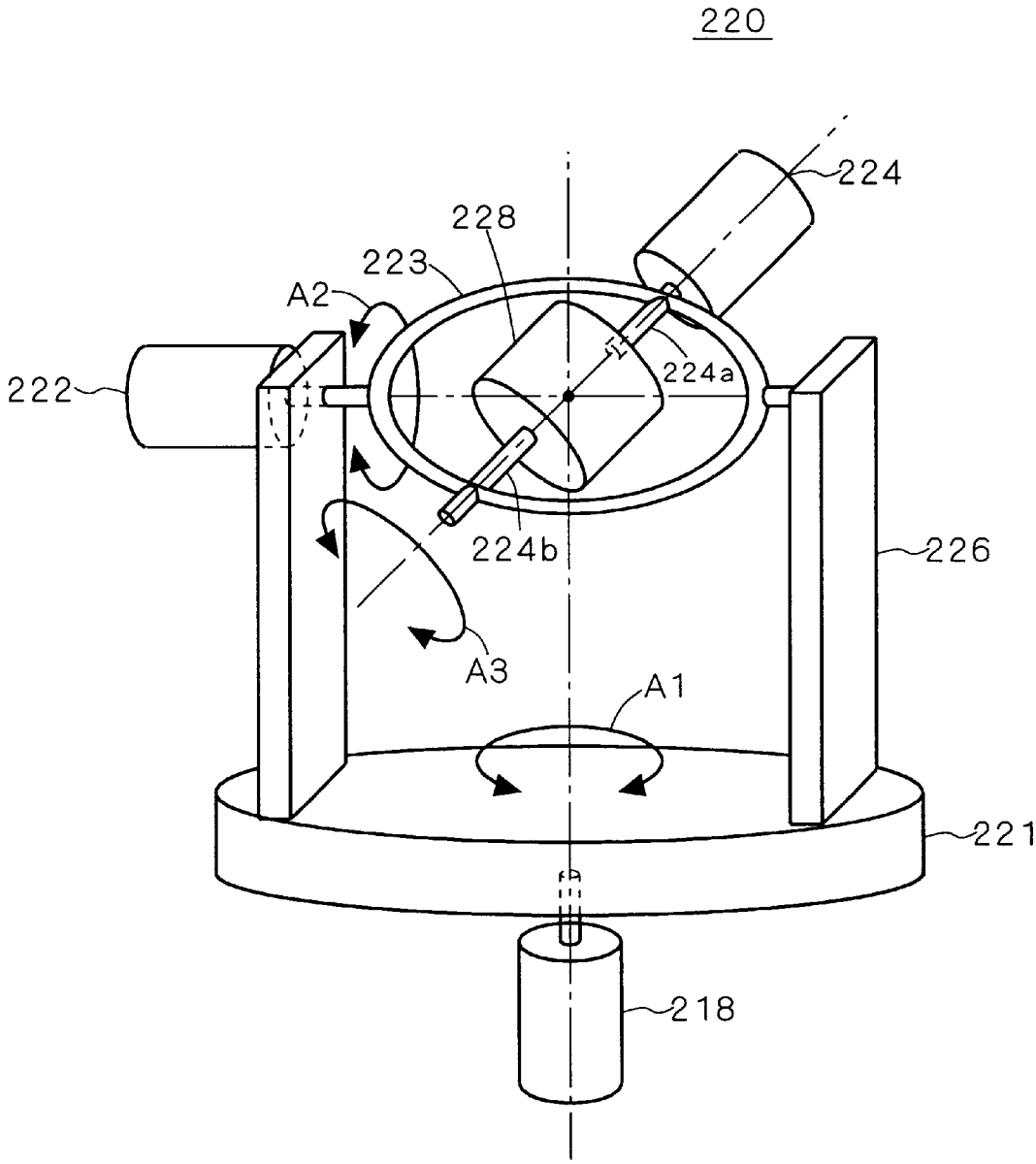
FIG. 15 is a structural diagram of an object-attitude changing section.
Figure 16:
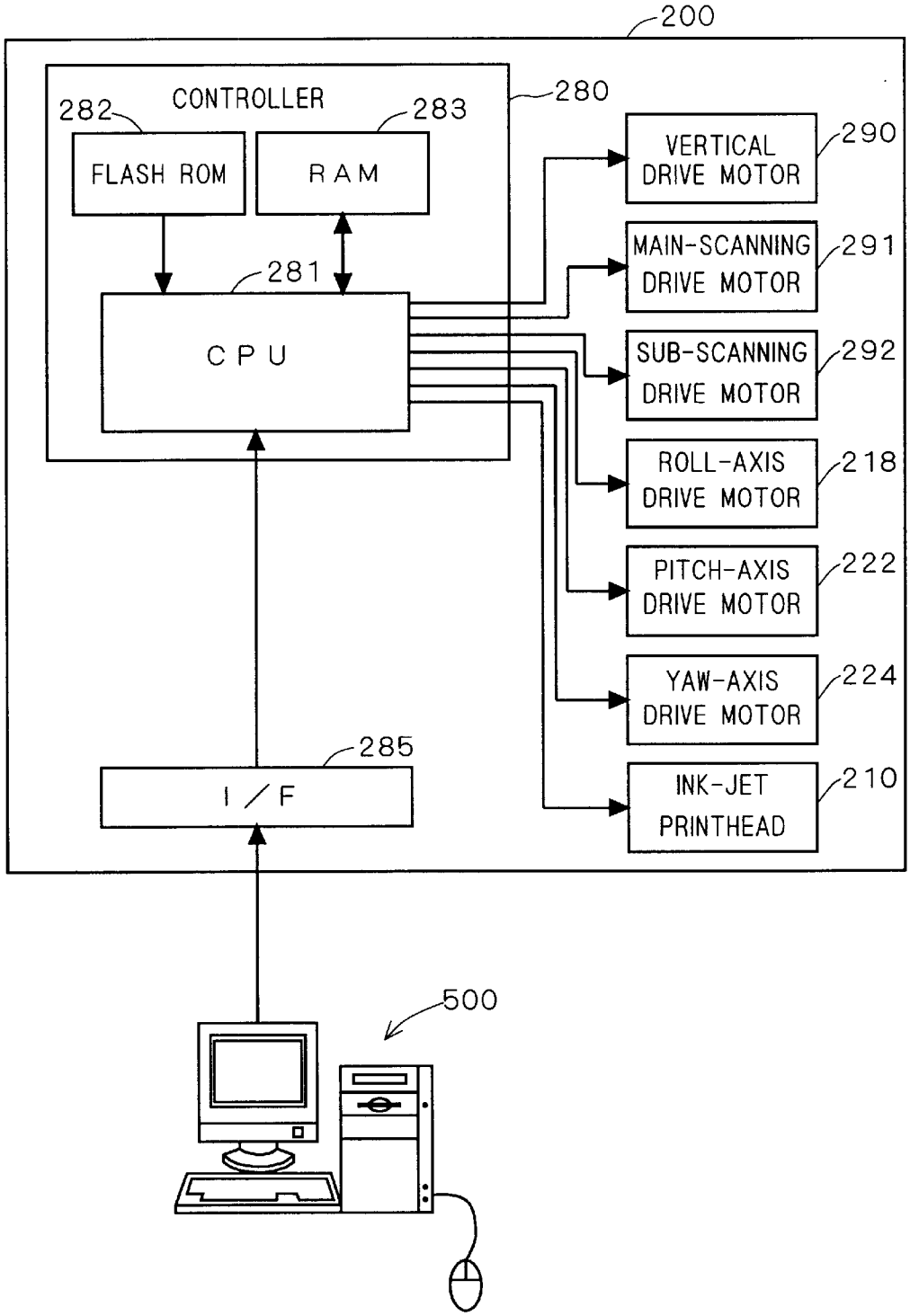
FIG. 16 is a block diagram of a drive control system according to the second preferred embodiment.

Now, a functional construction of a three-dimensional object printing apparatus (three-dimensional surface recording apparatus) 200 according to a second preferred embodiment is discussed. FIG. 14 is a schematic diagram of the three-dimensional object printing apparatus 200 when viewed from the front according to the second preferred embodiment, and FIG. 15 is a functional diagram of an object-attitude changing section 220 in this apparatus 200. FIG. 16 is a block diagram of a drive control system in the apparatus 200 along with a host computer (e.g., personal computer) 500. Referring now to FIGS. 14 to 16, the functional construction of the three-dimensional object printing apparatus 200 is discussed. As can be seen from FIGS. 14 to 16, the apparatus 200 of this preferred embodiment is nearly identical in construction to the apparatus 100 of the first preferred embodiment.

The apparatus 200 comprises a linear guide 215 located horizontally between two support bases 213 which are provided on a base plate 211. A main-scanning drive mechanism 212 is slidably mounted on the linear guide 215.

The main-scanning drive mechanism 212 comprises a main-scanning drive motor 291 (cf. FIG. 16). The linear guide 215 has a rack not shown, and the main-scanning drive motor 291 has a rotary shaft with pinions not shown. By rotation of the main-scanning drive motor 291, the main-scanning drive mechanism 212 is driven in a main scanning direction MD.

The two support bases 213 each comprise a sub-scanning drive mechanism 214 with a sub-scanning drive motor 292 (cf. FIG. 16). Each of the sub-scanning drive motors 292 has a rotary shaft with a timing belt thereon not shown. Both the timing belts are attached to the linear guide 215, so that when the sub-scanning drive motors 292 operate the timing belts, the linear guide 215 and the main-scanning drive mechanism 212 mounted thereon are driven in a sub-scanning direction SD.

An ink-jet printhead 210 moves in the main scanning direction MD together with the main-scanning drive mechanism 212 and at the same time ejects ink downward according to given data about an image to be printed (hereinafter referred to as a "print image") (more correctly, according to projected image data which will be discussed later). In this preferred embodiment, "printing" refers to recording of such a print image by means of coloring.

After one scan of printing is completed, the ink-jet printhead 210 is moved by the sub-scanning drive mechanisms 214 a single ink dot in the sub-scanning direction (in a direction perpendicular to the plane of the drawing).

The main-scanning drive mechanism 212 further comprises a vertical drive mechanism 216. The vertical drive mechanism 216 has a ball screw not shown and a vertical shaft 216*a* mounted to the ball screw juts downward out of the bottom of the vertical drive mechanism 216 and the bottom of the main-scanning drive mechanism 212 so as to be movable vertically. The vertical drive mechanism 216 further comprises a vertical drive motor 290 (cf. FIG. 16) to rotate the ball screw. The ink-jet printhead 210 mounted on the bottom of the vertical shaft 216*a* can be moved vertically by driving the vertical drive motor 290. Such a mechanism permits the adjustment of a distance between the ink-jet printhead 210 and a target area of a printing object 228 which will be described later.

As shown in FIG. 15, the object-attitude changing section 220 has three axes, namely roll, pitch, and yaw. A roll-axis drive motor 218, a pitch-axis drive motor 222, and a yaw-axis drive motor 224 hold the printing object 228 in any desired attitude.

The object-attitude changing section 220 to maintain and change the attitude of the printing object 228 is placed in the center of the upper surface of the base plate 211. The roll-axis drive motor 218 located inside the base plate 211 causes a roll-axis rotatable stage 221 in the object-attitude changing section 220 to rotate on the roll axis as indicated by the arrow A1.

The pitch-axis drive motor 222 is secured by a support base 226 to the roll-axis rotatable stage 221 and causes a holding ring 223 to rotate on the pitch axis as indicated by the arrow A2.

The yaw-axis drive motor 224 is secured to the holding ring 223. The yaw-axis drive motor 224 has a rotary shaft 224*a*, one end of which provides a mechanism of a clamp screw to hold the printing object 228, and has a rotary shaft 224*b* opposed to therotary shaft 224*a*, thereby providing a mechanism to sandwich and hold the printing object 228 between those rotary shafts. The yaw-axis drive motor 224 causes the printing object 228 to rotate on the yaw axis as indicated by the arrow A3.

The above three axes, roll, pitch, and yaw, cross each other perpendicularly at one point. As above described, the three-dimensional object printing apparatus 200 has a six-axis (roll, pitch, yaw, vertical, main scanning, and sub-scanning) drive mechanism and thus it can hold the printing object 228 in any desired attitude and can move the ink-jet printhead 210 to any desired position in movable space.

This apparatus 200 is characterized in that while using all the six axes or drive mechanisms for initial positioning of the ink-jet printhead 210 relative to the target area, it uses only two drive mechanisms, namely the main-scanning drive mechanism 212 and the sub-scanning drive mechanisms 214, for printing (coloring) on a target area which will be described later. By so doing, the apparatus 200 permits high-speed, high-precision printing like ordinary printers for flat-surface printing. This is because it is generally known that as the number of axes to be driven increases, orbital computations become complicated and positioning accuracy is degraded.

As shown in FIG. 16, the three-dimensional object printing apparatus 200 comprises a controller 280 which is a microcomputer with a flash ROM 282, a RAM 283, and the like connected to a CPU 281. The apparatus 200 is connected through an I/F 285 to the host computer 500 which comprises input devices such as a keyboard and a mouse, whereby the CPU 281 in the controller 280 can receive print image data about the printing object 228 from the host computer 500.

The CPU 281 reads out and executes a control program from the flash ROM 282. Thereby, the vertical drive motor 290, the main-scanning drive motor 291, and the sub-scanning drive motor 292 are operated to control the position of the ink-jet printhead 210 relative to the printing object 228, and the roll-axis drive motor 218, the pitch-axis drive motor 222, and the yaw-axis drive motor 224 are operated to change the attitude of the printing object 228. The CPU 281 further causes the ink-jet printhead 210 to eject ink toward the printing object 228 while controlling ejection timing on the basis of projected image data which has temporarily been stored in the RAM 283. This allows printing on any desired position on the printing object 228.

<2-2. Processing Overview>

Now, processing by the three-dimensional object printing apparatus 200 of the second preferred embodiment will be described in outline. In this preferred embodiment, the apparatus 200 comprises the aforementioned six-axis mechanism so that the ink-jet printhead 210 can be located opposite any desired point on the printing object 228 at any desired angle.

With such an ink-jet printhead 210 that can be located opposite any desired point on the printing object 228 at any desired angle, ideal printing can be accomplished by actually adjusting the position and attitude of the ink-jet printhead 210 relative to each point on the printing object 228 thereby to always hold the ink-jet printhead 210 at a predetermined angle with respect to the printing object 228 (e.g., at right angles to the surface of the printing object 228). In fact, for a three-dimensional object with only flat surfaces such as a polyhedron, relatively high-speed printing is possible because changes to the relative position and attitude of the ink-jet printhead 210 are infrequent.

For free-form surfaces, however, such a technique takes too much time and is thus of little practical use because of an increase in frequency of changes to the relative position and attitude of the ink-jet printhead 210.

Figure 17:
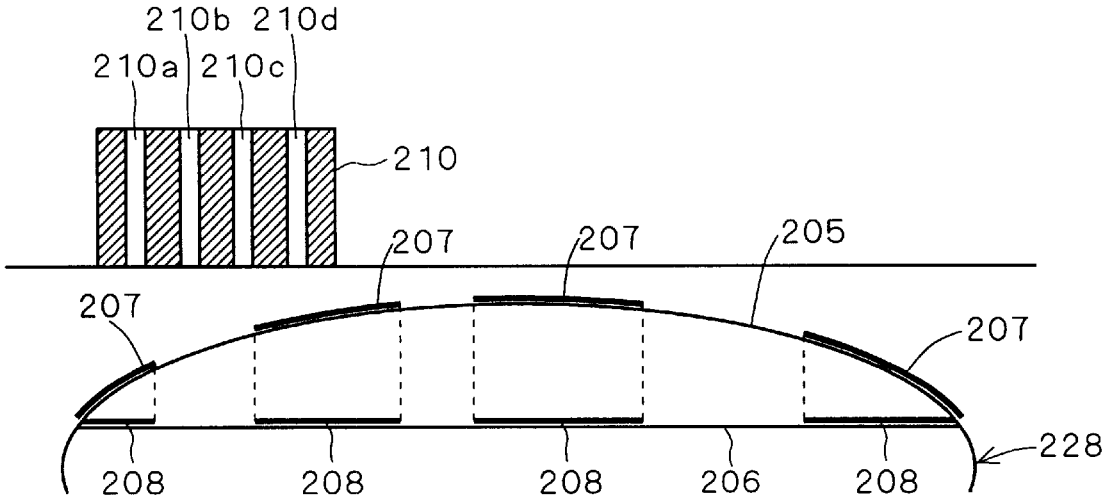
FIG. 17 shows the way of projection of a print image onto a projective plane.

This preferred embodiment therefore provides the following technique to improve print speed in printing on a three-dimensional object including at least in part a curved surface. FIG. 17 shows the way of projection of a print image 207 onto a projective plane (polygonal face) 206.

In this preferred embodiment, the surface of the printing object 228 is first divided into a plurality of target areas 205, each of which is then approximated by a projective plane 206. Here, the "target area" refers to an area of the surface of the printing object 228 which can be scanned without changing the attitude of the ink-jet printhead 210 relative to the surface of the printing object 228. Print image data is converted to image data about a projected image 208 (hereinafter referred to as "projected image data") by orthogonal projection of the print image 207 onto the projective planes 206.

This can readily be implemented by the use of a texture-mapping technique which is well known in the field of CG (computer graphics). More specifically, the coordinates of a point on a projective plane 206 are obtained by orthogonal projection of a point on the surface of a target area 205, while print image data (including color information, tone information, and information about image patterns of texture and the like) at the original point on the surface of the target area 205 is used without modification as projected image data at the projected point on the projective plane 206.

According to the projected image data, printing (main scanning and sub-scanning) is performed on the target area 205 while moving the ink-jet printhead 210 in parallel with the projective plane 206. That is, high-speed printing on the surface of the printing object 228 is accomplished by reducing the number of times that the attitude of the ink-jet printhead 210 relative to the printing object 228 is controlled. FIG. 17 shows a cross-section of the ink-jet printhead 210 which is a multinozzle ink-jet printhead with four ink nozzles 210*a* to 210*d*.

To prevent degradation in printing performance, the division of a three-dimensional object surface into a plurality of areas is made such that the projective planes 206 to be produced satisfy the following two requirements.

Figure 18A:
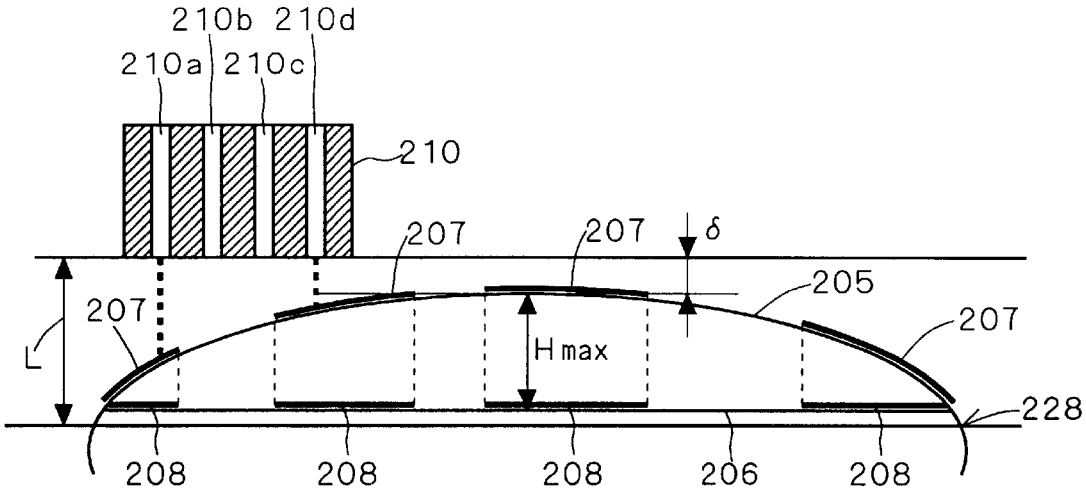
FIGS. 18A and 18B are explanatory diagrams of a requirement for the distance between an ink-jet printhead and a target area.
Figure 18B:
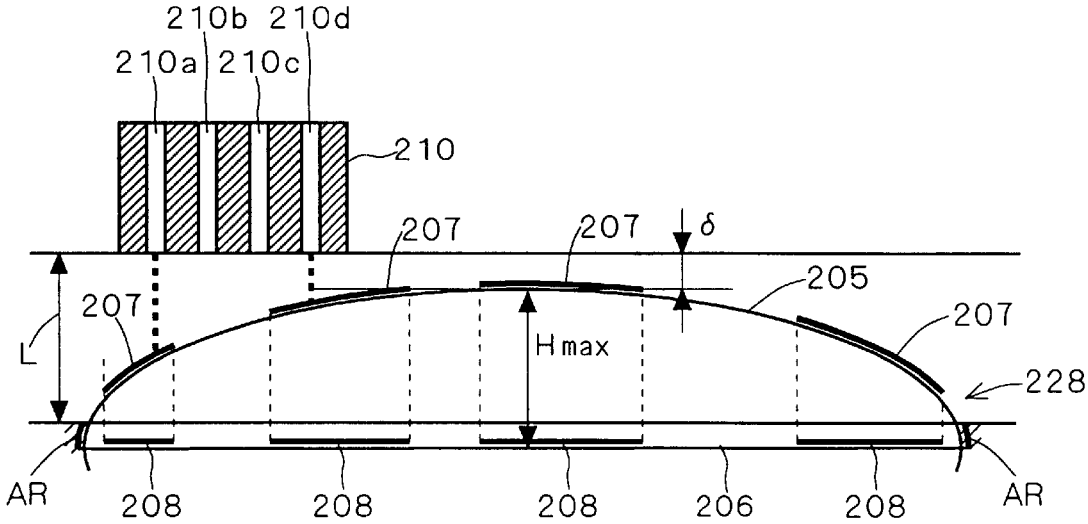

FIGS. 18A and 18B are explanatory diagrams of a requirement for the distance between the ink-jet printhead 210 and a target area 205 (hereinafter referred to as a "first requirement"). In FIGS. 18A and 18B, a cross-section of the printing object 228 perpendicular to a projective plane 206 is shown.

The first requirement is that the distance between the ink-jet printhead 210 and a target area 205 should fall within such a range as not to degrade print quality. That is, if H max represents the maximum value of the foot of a perpendicular dropped from a target area 205 and meeting a corresponding projective plane 206 (i.e., the distance between the target area 205 and the corresponding projective plane 206 in a direction perpendicular to the projective plane 206) and 8 represents a proper offset value to prevent the ink-jet printhead 210 from being in contact with the printing object 228, the following equation should be satisfied:

$$H\max+\delta \leq L \quad (1)$$

where L is the critical distance which is the maximum permissible distance from the ink-jet printhead 210 with acceptable levels of degradation in print quality (i.e., the maximum prescribed distance that can ensure a predetermined level or more of recording quality).

Figure 19:
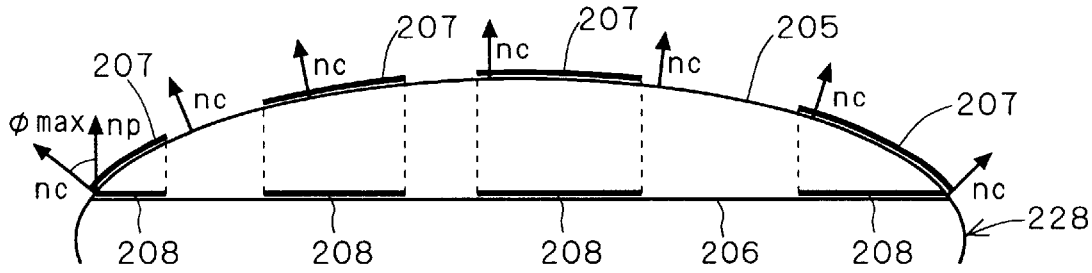
FIG. 19 is an explanatory diagram of a requirement for the angle of inclination of a target area with respect to a direction of ink ejection.

FIG. 19 is an explanatory diagram of a requirement for the angle of inclination of a target area 205 with respect to a direction of ink ejection (hereinafter referred to as a "second requirement").

The second requirement is that the inclination angle of a target area 205 with respect to the direction of ink ejection should fall within such a range as not to degrade print quality. That is, if $\phi max$ represents the maximum inclination angle $\phi$ of a target area 205, the following equation should be satisfied:

$$\phi max \leq \psi \quad (2)$$

where $\psi$ is the critical inclination angle which is the maximum permissible inclination angle formed by unit normal vectors nc and np with acceptable levels of degradation in print quality (the maximum prescribed angle that can ensure a predetermined level or more of recording quality).

Figure 20A:
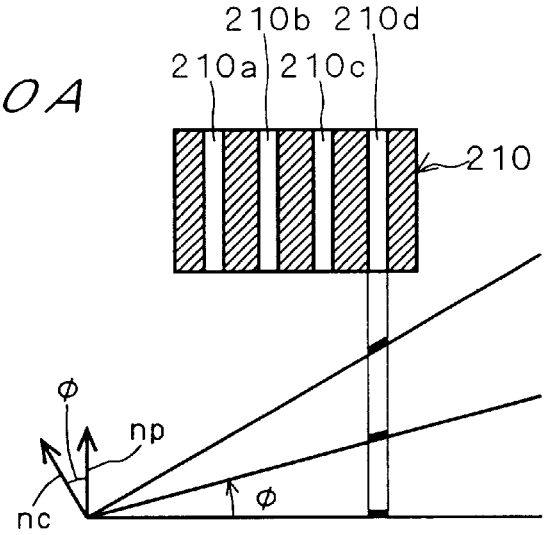
FIGS. 20A, 20B, and 20C illustrate how the shapes of ink dots to be formed on the surface of an object vary according to the inclination of the ink-jet printhead relative to the object.
Figure 20B:
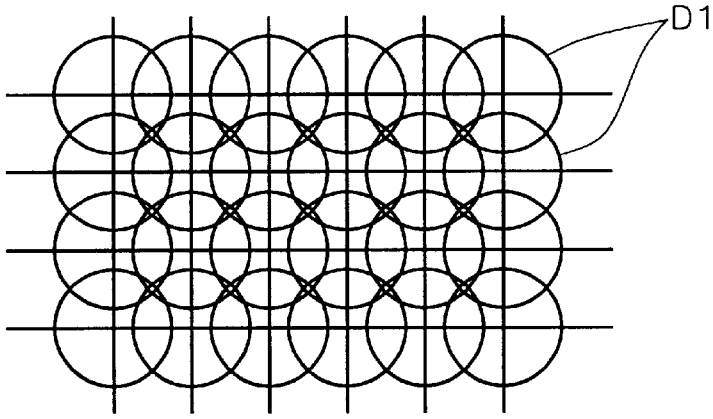
Figure 20C:
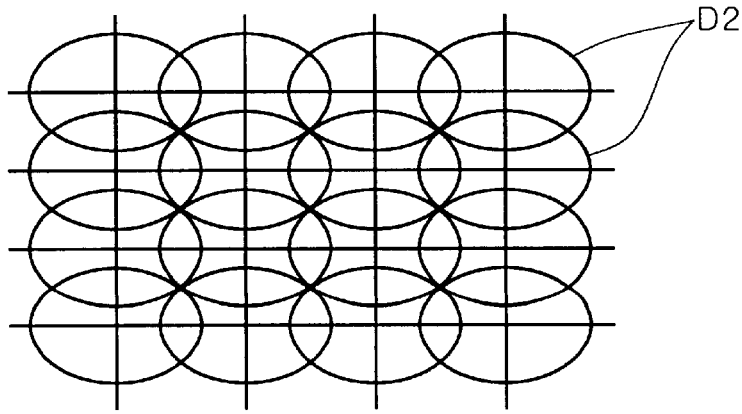

FIGS. 20A to 20C illustrate how the shapes of ink dots formed on the surface of the printing object 228 vary according to the inclination of the ink-jet printhead 210 relative to the printing object 228.

Now, the interpretations of the first and second requirements (Equations (1) and (2)) will be given in detail.

First, the interpretation of the first requirement is made with reference to FIGS. 18A and 18B. If the gap between the ink-jet printhead 210 and the printing object 228 increases, the degree of deviation from ink-dot striking positions increases and thus print quality is degraded. Especially for a multinozzle, it is considered that if the directions of ink ejection vary from nozzle to nozzle, an increase in gap considerably affects degradation in print quality. Thus, the critical distance L with acceptable levels of degradation in print quality can be determined empirically by varying the gap between the ink-jet printhead 210 and the printing object 228.

The offset value $\delta$ represents, in other words, the minimum clearance between the printing object 228 and the ink-jet printhead 210. The first requirement (Equation (1)) therefore assures that all the points in the target area 205 will be located within such a distance as not to degrade print quality.

FIG. 18A shows that all the points in the target area 205 are located within the critical distance L with acceptable levels of degradation in print quality, while FIG. 18B shows that some of the points in the target area 205 are located outside the critical distance L. In the case of FIG. 18B, a diagonally-shaded area AR is located outside the critical distance L that ensures print quality and therefore the required level of print quality cannot be achieved.

Here, the critical distance L is not a fixed value but is selectable as appropriate depending on the user-desired level of image quality. That is, the critical distance L is set short when high image quality is required even at the expense of long print time; in this case, the number of divided projective planes and required print time increase. On the contrary, the critical distance L is set long when short print time is required even at the expense of low image quality; in this case, the number of divided projective planes and required print time decrease.

Next, the interpretation of the second requirement is made with reference to FIGS. 19 and 20A to 20C. As shown in FIG. 19, the unit normal vector nc is obtained for every point in the curved area (target area) 205 of the surface of the printing object 228, and the unit normal vector np of the projective plane 206 corresponding to the target area 205 is obtained. Then, the inclination angle $\phi$ formed by the unit normal vector np and each of the unit normal vectors nc is obtained from the following equation:

$$\phi = \cos^{-1}(nc \cdot np) \quad (3)$$

Since the main scanning direction and the sub-scanning direction of the ink-jet printhead 210 are parallel to the projective plane 206, the inclination angle $\phi$ formed by the unit normal vectors nc and np represents the angle of inclination of a printing surface with respect to the direction of ink ejection. This is shown in FIG. 20A. Where $\phi=0°$, ink dots D1 formed on the surface have the shapes of perfect circles as shown in FIG. 20B. With surface inclination, however, ink dots D2 become elliptical in shape as shown in FIG. 20C. The greater the inclination angle $\phi$, the higher is the ratio of the major axis to the sub-axis of each ellipse. An increase in the ratio of the major axis to the sub-axis deteriorates image resolution in the direction of the major axis, thereby degrading print quality. The critical inclination angle $\psi$ with acceptable levels of degradation in print quality can thus be determined empirically by varying the inclination angle $\phi$ of the surface of the printing object 228 relative to the ink-jet printhead 210. The second requirement assures that the inclination angles of all the points in the target area 205 will fall within such limits as not to degrade print quality.

Here, the critical inclination angle $\psi$, like the critical distance L, is not a fixed value but is selectable as appropriate depending on the user-desired image quality. That is, the critical inclination angle $\psi$ is set small when high image quality is required even at the expense of long print time; in this case, the number of divided polygons and required print time increase. On the contrary, the critical inclination angle $\psi$ is set large when short print time is required even at the expense of low image quality; in this case, the number of divided polygons and required print time decrease.

The critical inclination angle $\psi$ and the critical distance L are entered through an input device not shown or the host computer 500 and stored in the flash ROM 282.

<2-3. Concrete Processing>

Figure 21:
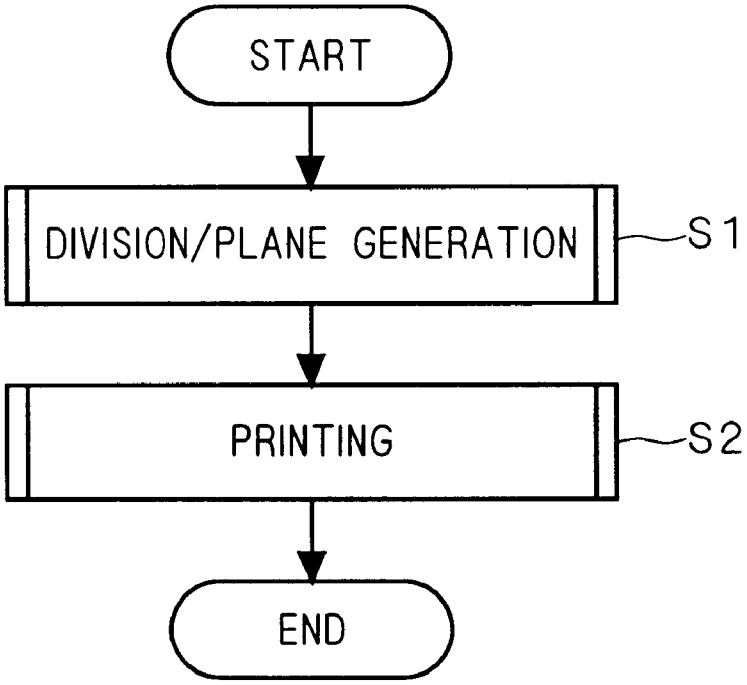
FIG. 21 is a flow chart of a three-dimensional object printing process according to the second preferred embodiment.
Figure 22:
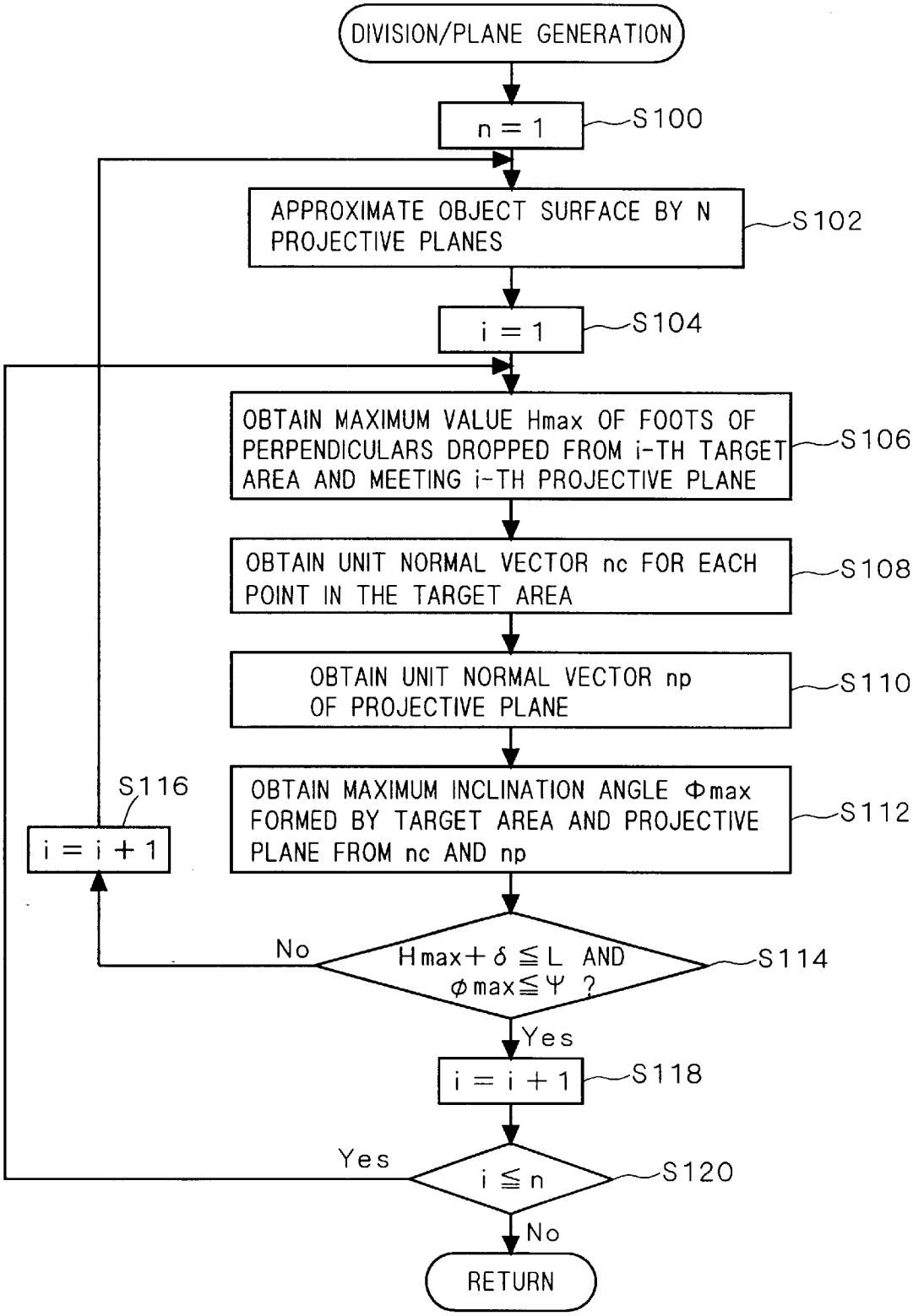
FIG. 22 is a flow chart of a division/plane-generation operation in the three-dimensional object printing process.
Figure 23:
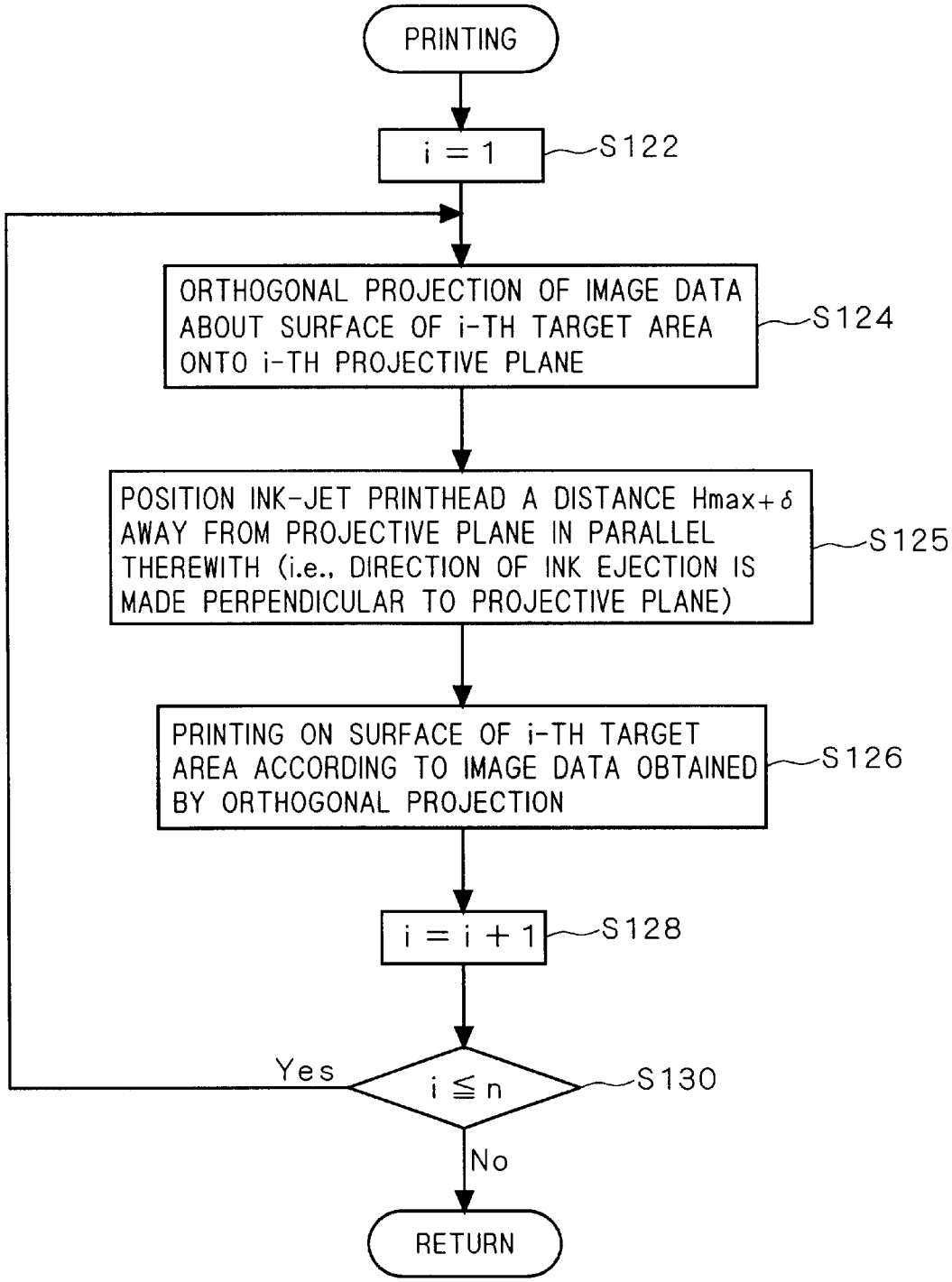
FIG. 23 is a flow chart of a printing operation in the three-dimensional object printing process.

FIG. 21 is a flow chart of a three-dimensional object printing process according to the second preferred embodiment. FIGS. 22 and 23 are flow charts of a division/plane-generation operation and a printing operation, respectively, in the three-dimensional object printing process. Referring now to FIGS. 21 to 23, the three-dimensional object printing process is discussed. Unless otherwise specified, a variety of computations and control over the ink-jet printhead 210 and the various drive motors are exercised by the controller 280.

First, the division/plane-generation operation is performed (step S1 of FIG. 21). In this example, the surface of the printing object 228 is first approximated by one or a plurality of projective planes 206. Shape data about the printing object 228 is obtained by extracting characteristic quantities (e.g., the bottom radius, the height, etc. of the cones) from previously obtained data such as shape data for CAD, CG or measurement data from a three-dimensional shape measuring device not shown.

Referring now to FIG. 22, the division/plane-generation operation is discussed.

First, the number of divisions n, by which the surface of the printing object 228 is divided, is initialized to 1 (step S100).

Then, the surface of the printing object 228 is divided into n target areas 205, each of which is then approximated by a projective plane 206 (step S102).

An index i that specifies a target area 205 (and a corresponding projective plane 206) is initialized to 1 (step S104).

The maximum value H max of the foots of perpendiculars dropped from the i-th target area 205 and meeting a corresponding (i-th) projective plane 206 is obtained (step S106).

Figure 24A:
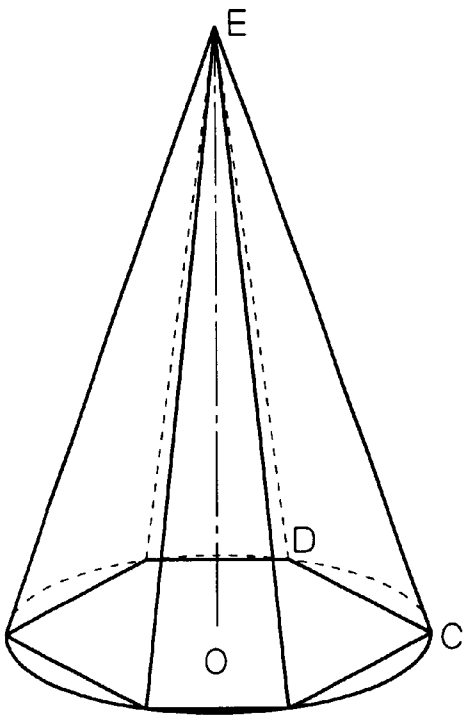
FIGS. 24A, 24B, and 24C illustrate the division/plane-generation operation performed on a conical surface.
Figure 24B:
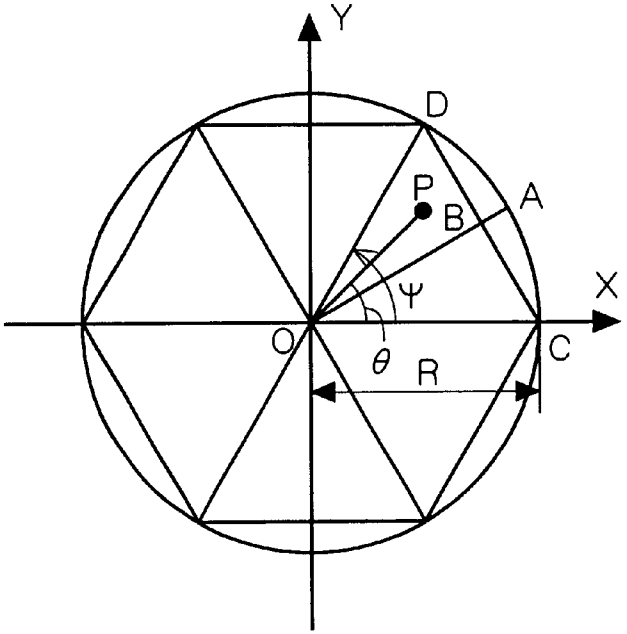
Figure 24C:
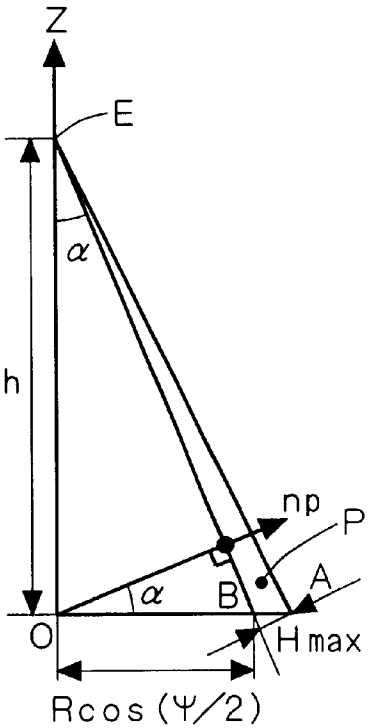

To be more concrete, a cone is taken as an example of the shape of the printing object 228 and printing on a conical surface of the cone is hereafter described. FIGS. 24A to 24C are explanatory diagrams of the division/plane-generation operation performed on the conical surface; more specifically, FIG. 24A is a side view, FIG. 24B is a plan view, and FIG. 24C is a cross-sectional view.

As shown in FIGS. 24A and 24B, the cone is approximated by a regular n-sided pyramid. Here, n≧2. Since a triangle ACED and the other (n−1) triangles, all of which are side surfaces of the right n-sided pyramid, are congruent with each other, herein only an area of the conical side surface which is cut off by the side surface ΔCED (cf. FIG. 24A) is noted and the same can be said of the other areas. The maximum value H max of the foots of perpendiculars dropped from that area of the cone and meeting the side surface ΔCED is obtained.

Where n=2, an approximation of the cone is not a regular multi-sided pyramid but a plane. This indicates that printing is performed on both sides of an isosceles triangle which is obtained by dividing the cone from the center.

FIG. 24C is a cross-sectional view taken along a section ΔOAE, where B is the midpoint of the side CD and A is the point of intersection of the extension of the line OB and the periphery of the bottom surface of the cone. As is evident from FIGS. 24B and 24C, the maximum value H max is the foot of a perpendicular dropped from the point A and meeting the side surface ΔCED; therefore, similitude relations between the triangles can be expressed as:

$$\text{EO:EB=H max:AB} \tag{4}$$

This is more specifically written as:

$$h/a = H\ \max/R(1-\cos(\psi/2)) \tag{5}$$

The maximum value H max of the foots of perpendiculars is thus found from the following equation:

$$H\max = hR(1-\cos(\psi/2))/a \tag{6}$$

$$\text{where } a = \sqrt{h^2 + R^2\cos^2(\psi/2)}$$

In this way, the maximum value H max of the foots of perpendiculars to the cone is obtained.

Next, the unit normal vector nc is obtained for every point in the i-th target area 205 (step S108 of FIG. 22).

In the example of the above cone, where $p=(x,y,z)^T$ represents the coordinate vector of a point P on the conical surface of the cone which is cut off by the i-th triangle, the index i takes any integer satisfying 1≦i≦n≦. If the angle θ is defined by the following equation:

$$\frac{2(i-1)}{n}\pi \le \theta \le \frac{2i}{n}\pi \tag{7}$$

the values x, y, z can be expressed respectively as follows:

$$x = \frac{h-z}{h}R\cos\theta \tag{8}$$

$$y = \frac{h-z}{h}R\sin\theta \tag{9}$$

In general, the unit normal vector is defined by the following equation:

$$n(\theta, z) = \left(\frac{\partial p(\theta, z)}{\partial\theta} \times \frac{\partial p(\theta, z)}{\partial z}\right) \Big/ \left|\left(\frac{\partial p(\theta, z)}{\partial\theta} \times \frac{\partial p(\theta, z)}{\partial z}\right)\right| \tag{11}$$

From Equations (8) to (10), the unit normal vector nc at the point p is found from the following equation:

$$nc = \left(\frac{h}{\sqrt{h^2+R^2}}\cos\theta,\ \frac{h}{\sqrt{h^2+R^2}}\sin\theta,\ \frac{R}{\sqrt{h^2+R^2}}\right) \tag{12}$$

In this way, the unit normal vector nc at the point p on the cone is obtained.

Next, the unit normal vector np of the i-th projective plane 206 is obtained (step S110 of FIG. 22).

In the example of the above cone shown in FIGS. 24B and 24C, the unit normal vector np of the projective plane 206 is found from the following equation:

$$np = \left(\cos\alpha\cdot\cos\frac{2i-1}{n}\pi,\ \cos\alpha\cdot\sin\frac{2i-1}{n}\pi,\ \sin\alpha\right) \tag{13}$$

$$\text{where } \cos\alpha = \frac{h}{\sqrt{h^2 + R^2\cos^2\frac{2i-1}{n}\pi}},$$

$$\sin\alpha = \frac{R\cos\frac{2i-1}{n}\pi}{\sqrt{h^2 + R^2\cos^2\frac{2i-1}{n}\pi}}$$

In this way, the unit normal vector np of the projective plane 206 for the cone is obtained.

Referring back to FIG. 22, a set of inclination angles ϕ formed by the i-th target area 205 and the i-th projective plane 206 is obtained from the unit normal vectors nc at the respective points in the target area 205 and the unit normal vector np, from which then the maximum inclination angle 4 max is obtained (step S112).

In the example of the above cone, the unit normal vectors nc and the unit normal vector np are obtained from Equations (12) and (13), respectively. and the inclination angles ϕ at a point defined by any angle θ satisfying Equation (7) is obtained found from Equation (3). Then, the inclination angles ϕ at all the points in the target area 205 are obtained, from which the maximum inclination angle ϕmax is obtained.

After that, whether or not both the aforementioned first and second requirements are satisfied is determined (step S114). If both are satisfied, the process goes to step S118. Otherwise, the number of divisions n is incremented by 1 (step S116) and the process returns to step S102. This determination refers to the critical distance L and the critical inclination angle ψ which have previously been obtained by experiment and stored in the flash ROM 282.

In the example of the above cone, the maximum value H max of the foots of perpendiculars and the maximum inclination angle $\phi$max are obtained in steps S106 and S112, respectively, and used in the determination of step S114.

When both the first and second requirements are satisfied, the index i is incremented by 1 (step S118).

Then, whether or not the index i is not more than the number of divisions n is determined (step S120). If the index i is not more than the number of divisions n, the process returns to step S106. Otherwise, the process goes to the printing operation.

This completes the division/plane-generation operation, whereby the surface of the printing object 228 is divided into n target areas 205, each of which is approximated by the projective plane 206. Where n=1, the surface of the printing object 228 is nearly a plane.

Next, the printing operation is performed (step S2 of FIG. 21), which will now be described in detail with reference to FIG. 23.

First, the index i that specifies a target area 205 for printing is initialized to 1 (step S122). That is, the following steps are performed for each of the target areas 205 starting from the first target area 205.

As previously described, print image data about an image to be printed on the surface of the i-th target area 205 is converted into projected image data about a projected image which is obtained by orthogonal projection of the target area 205 onto a corresponding (i-th) projective plane 206 (step S124).

Then, the drive motors other than the main-scanning drive motor 291 and the sub-scanning drive motor 292, namely the vertical drive motor 290, the roll-axis drive motor 218, the pitch-axis drive motor 222, and the yaw-axis drive motor 224 are driven so that the ink-jet printhead 210 is located in a position a distance H max+$\delta$ away from the i-th projective plane 206 in parallel therewith (step S125). Here, the attitude of the ink-jet printhead 210 relative to the printing object 228 is determined such that the direction of ink ejection is perpendicular to the i-th projective plane 206.

The ink-jet printhead 210 then scans the projective plane 206 in parallel therewith in both the main scanning and the sub-scanning directions while ejecting ink according to the projected image data, whereby printing is done (step S126). As can be seen from FIG. 17, printing based on the projected image data results in the formation of the print image 207 on the surface of the target area 205. At this time, only the main-scanning drive mechanism 212 (accordingly, the main-scanning drive motor 291) and the sub-scanning drive mechanisms 214 (accordingly, the sub-scanning drive motors 292) are driven. The other four drive motors are used only for positioning of the ink-jet printhead 210 in step S125. This permits high-speed printing.

The index i is then incremented by 1 (step S128).

Then, whether or not the index i is not more than the number of divisions n is determined (step S130). If the index i is not more than the number of divisions n, the process returns to step S124 and repeats the processing of steps S124 to S130. Otherwise, printing operations on all the target areas 205 are completed, that is, the three-dimensional object printing process is completed.

Figure 25:
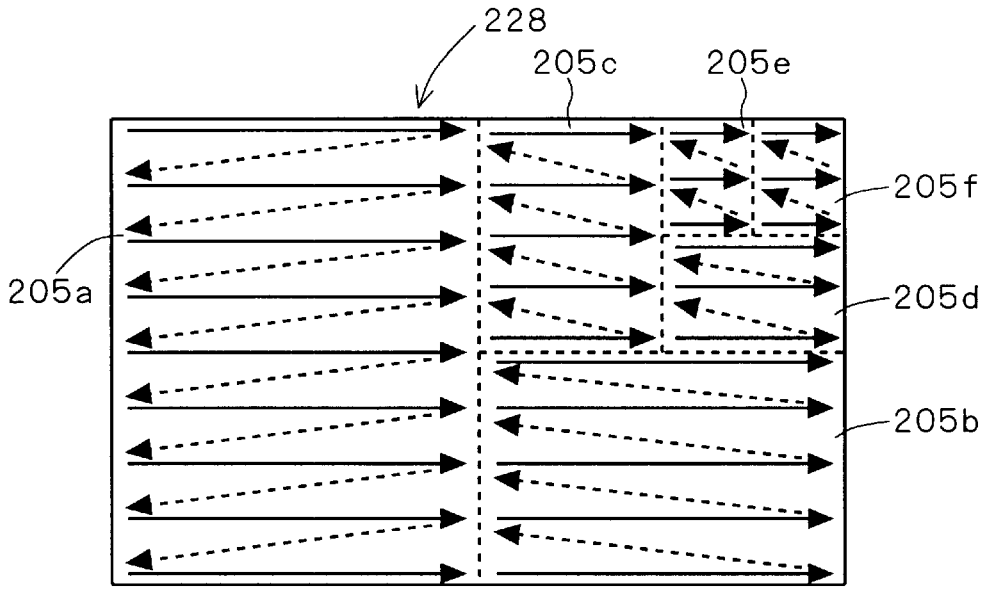
FIG. 25 shows the way of scanning in printing according to the second preferred embodiment.

FIG. 25 shows the way of scanning in printing according to this preferred embodiment. In the second preferred embodiment as above described, scanning is performed for each of the target areas 205. That is, after the scanning of the whole of a target area specified by the index i is completed, the index i is incremented by 1 and the scanning of the next target area is started. The same is repeated hereinafter, whereby all the target areas scanned in sequence. In the example of FIG. 25, printing on a whole target area 205*a* is first performed by scanning in the main direction (indicated by arrows in solid lines) and in the sub-scanning direction (indicated by arrows in broken lines) and then printing on a whole target area 205*b* is performed. Hereafter, printing on target areas 205*c*, 205*d*, 205*e*, and 205*f* is performed in sequence in the same manner.

According to this second preferred embodiment, the target areas 205 of the surface of the printing object 228 are approximated by the projective planes 206, and projected image data about a print image to be projected onto the projective planes 206 is obtained in order to perform printing on the target areas 205 according to the projected image data. This facilitates control of the position and attitude of the ink-jet printhead 210 relative to the surface of the printing object 228 as compared with the case where image printing is performed in accordance with the shape of the printing object 228, thereby permitting high-speed printing.

Further, since the surface of the printing object 228 is divided into a plurality of target areas depending on its shape and printing is based on the projected image data corresponding to each of the plurality of target areas, the precision of printing can be improved as compared with the case where the whole surface of the printing object 228 is considered as a single target area in printing of a projected image.

Furthermore, since the surface of the printing object 228 is divided into a plurality of target areas depending on its shape, and the position and attitude of the ink-jet printhead 210 relative to the surface of the printing object 228 are changed for each of the plurality of target areas, printing can be performed under careful control of the relative position and angle of the ink-jet printhead 210. This reduces the occurrence of distortion during printing, thereby further improving the precision of printing.

Since the directions of projection of a print image onto the projective planes 206, which are approximation of the target areas 205, vary from target area to target area, they can be made almost perpendicular to the surface of a three-dimensional object. Thus, printing can be performed on the basis of an image with a small amount of distortion, which further improves the precision of printing.

A plurality of projective planes 206 are obtained such that the distances between target areas and corresponding projective planes 206 are smaller than the predetermined critical distance L. This achieves relatively good print quality.

The critical distance L is the maximum distance with acceptable levels of print quality. Thus, a permissible level or more of print quality can be ensured.

A plurality of projective planes 206 are obtained such that the maximum angle $\phi$ max formed by any of the unit normal vectors nc at all the points in a target area and the unit normal vector np of a corresponding projective plane 206 is smaller than the predetermined critical inclination angle $\psi$. This achieves relatively good print quality.

The critical inclination angle $\psi$ is the maximum angle with acceptable levels of print quality. Thus, a permissible level or more of print quality can be ensured.

The ink-jet printhead 210 moves in parallel with the projective planes 206 with its attitude relative to the surface of the printing object 228 being maintained such that the direction of ink ejection is perpendicular to the projective planes 206 and with its position relative to the surface of the printing object 228 being maintained such that there is a predetermined distance H max+$\delta$ from the projective planes 206. This assures relatively high-precision printing and facilitates control of the attitude and position of the printhead relative to the surface of a three-dimensional object, thereby permitting high-speed printing.

In printing, further, the ink-jet printhead 210 performs main scanning and sub-scanning for each of a plurality of target areas. This facilitates control of the attitude and position of the ink-jet printhead 210 relative to the surface of the printing object 228.

<3. Third Preferred Embodiment>

As is evident from the aforementioned second preferred embodiment which takes a cone as an example, a printing object 228 of simple shape (i.e., a small number of parameters) such as a body of revolution is easy to control. However, it is difficult to apply the same technique to a printing object 228 of complex shape or a printing object 228 with free-form surfaces which are given as point group data (coordinate data representing the position of each point on the surface of the printing object 228 in three-dimensional space).

Figure 26:
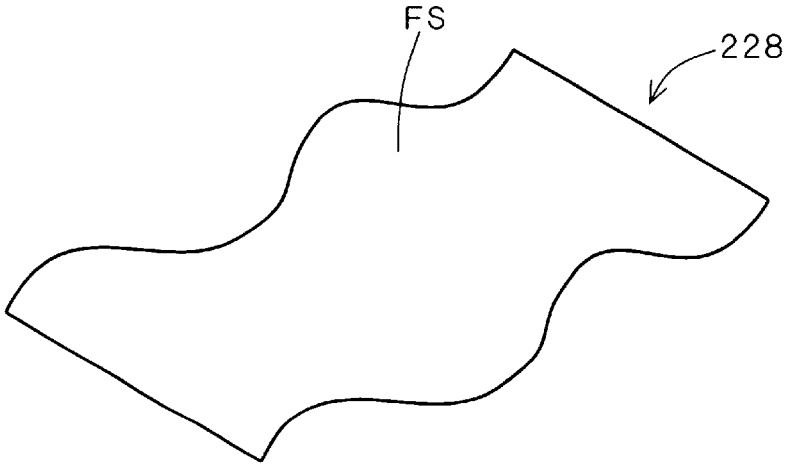
FIG. 26 shows a printing object with a free-form surface.

A third preferred embodiment thus provides a technique of the division/plane-generation operation that is applicable to a printing object 228 with a free-form surface FS for example as shown in FIG. 26. A three-dimensional object printing apparatus according to the third preferred embodiment is functionally identical to the apparatus 200 of the second preferred embodiment.

Figure 27:
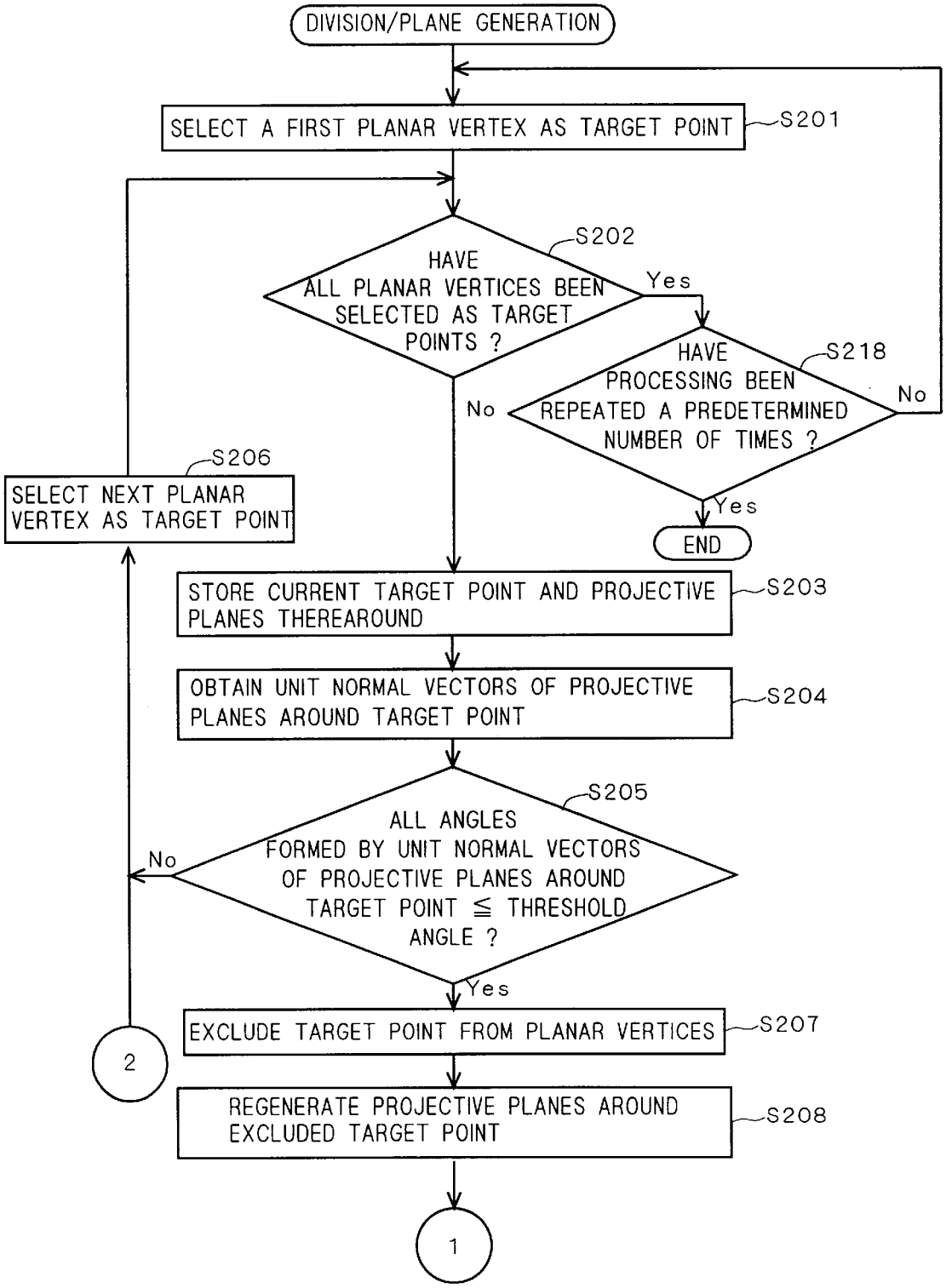
FIGS. 27 and 28 are flow charts of a division/plane-generation operation in the three-dimensional object printing process according to a third preferred embodiment.
Figure 28:
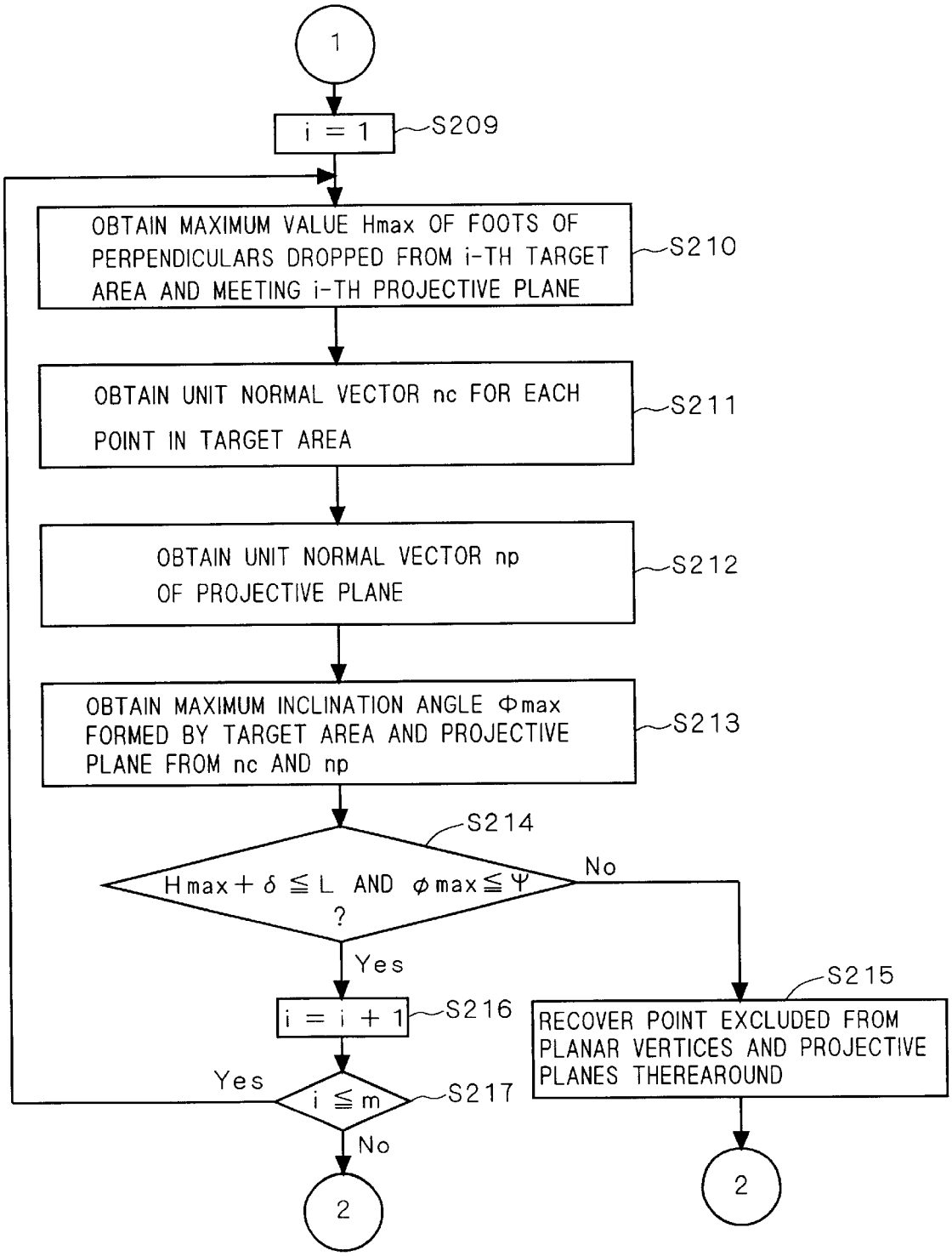

FIGS. 27 and 28 are flow charts of the division/plane-generation operation in the three-dimensional object printing process according to the third preferred embodiment. Unless otherwise specified, a variety of computations and control over the ink-jet printhead 210 and the various drive motors are exercised by the controller 280. Further, previously obtained point group data such as shape data for CAD, CG or measurement data from a three-dimensional shape measuring device not shown is used as shape data about the printing object 228. Prior to the following operation, data about every point is previously divided into target areas, each consisting of three adjacent points, under prescribed rules. Hereinafter, the division into target areas at this stage and the generation of projective planes are referred to as "initial division".

Figure 29:
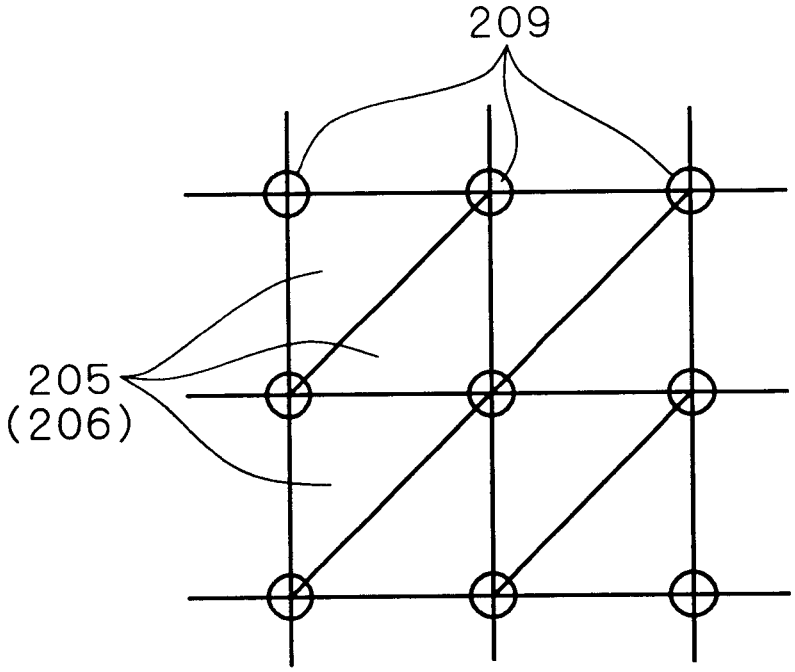
FIG. 29 shows the way of initial division according to the third preferred embodiment.

FIG. 29 shows the way of initial division according to the third preferred embodiment. In the example of FIG. 29, a single triangular target area 205 (and a projective plane 206) are made of each point 209 and its two adjacent points 209 which are located respectively under and on the right side of that point. As can be seen from this example, at this initial-division stage, every point 9 makes a vertex of any of the projective planes 206 (hereinafter referred to as a "planar vertex"), that is, the target areas 205 coincide with the projective planes 206. From this, any of the target areas 205 satisfies, as a matter of course, the first and second requirements.

In this condition, however, there are too many target areas and printing will take too much time, which is no different from printing by means of attitude control of the printing object 228 at each point. For this reason, the number of divisions, i.e., target areas 205, is reduced by the following operation.

Figure 30A:
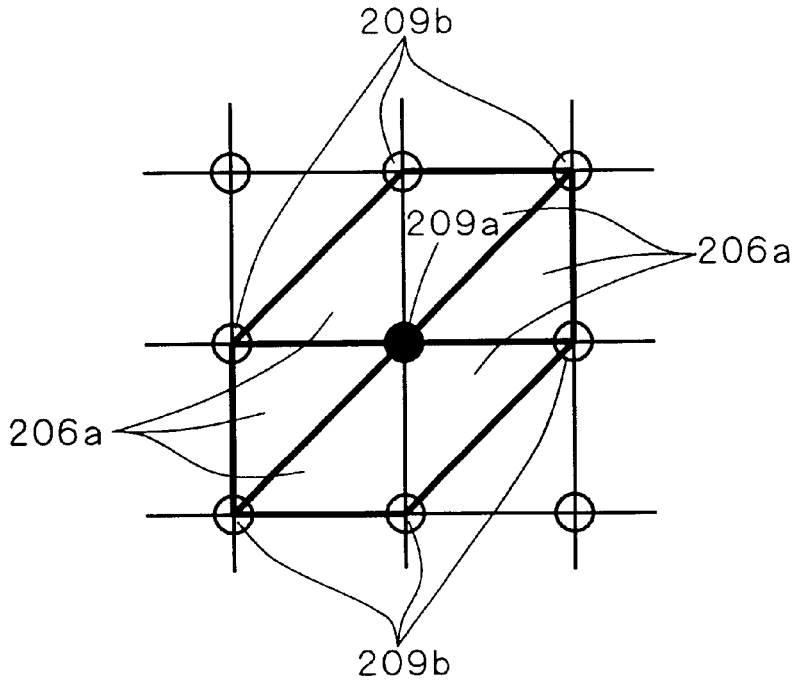
FIGS. 30A and 30B are explanatory diagrams illustrating projective planes around a target point and an operation for excluding a target point from planar vertices.
Figure 30B:
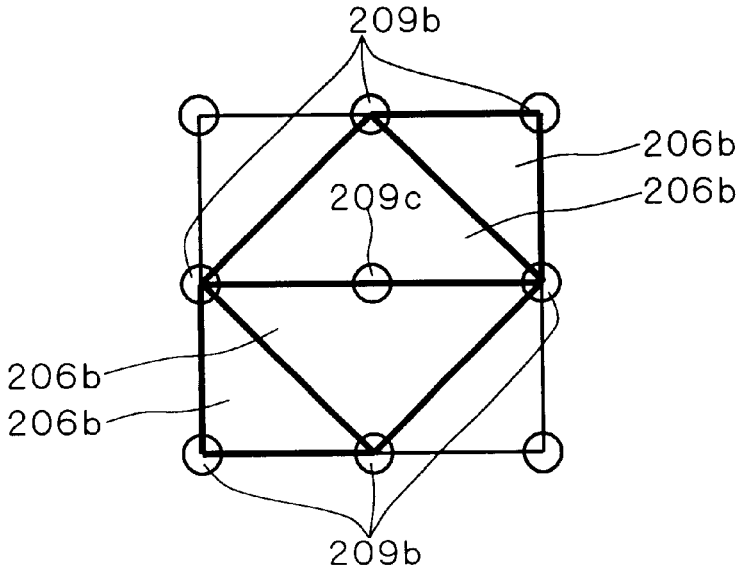

FIGS. 30A and 30B are explanatory diagrams of the operation to reduce the number of divisions. FIG. 30A and FIG. 30B, respectively, show the states before and after the exclusion of a target point 209*a* from planar vertices 209*b*.

Referring now to FIG. 27, a first planar vertex 209*b* is selected from a set of planar vertices as a target point 209*a* (step S201).

Then, whether or not all planar vertices have been selected as target points is determined (step S202). If all the planar vertices have already been selected as target points, the process goes to step S218. Otherwise, the process goes to step S203.

In step S203, the current target point and projective planes therearound are stored in the RAM 283. In FIG. 30A, there are six projective planes 206*a* around the target point 209*a*.

Then, the unit normal vectors np of the projective planes around the target point are obtained (step S204). Since a direction perpendicular to each of the projective planes can be geometrically obtained with ease from the coordinates of planar vertices which defines that projective plane, the unit normal vectors np of the projective planes can readily be obtained.

Then, it is determined whether or not every angle formed by the unit normal vectors np of the projective planes around the target point is not more than a predetermined threshold angle (step S205). If not all the angles are not more than the threshold angle, the next planar vertex is selected as a target point (step S206) and the process returns to step S202. On the other hand, if all the angles are not more than the threshold angle, the process goes to step S207. Herein, the threshold angle is a threshold value to determine whether the angles (inclination) formed by the projective planes around the target point are small or not; that is, when the angles are small, it is determined that those projective planes can be integrated. The angles formed by the unit normal vectors np of the projective planes can readily be obtained by substituting the unit normal vectors np of the projective planes around the target point for the unit normal vectors nc in Equation (3).

When all the angles formed by the unit normal vectors np of the projective planes around the target point are not more than the threshold angle, the target point is excluded from the planar vertices (step S207). That is, the target point is not included in any of the projective planes. However, this excluded point is still a point on the surface of the printing object 228 and thus its coordinate data will be held as it is. In FIG. 20B, the target point 209*a* of FIG. 20A is excluded from the planar vertices 209*b* and shown as a point 209*c*.

Then, projective planes are regenerated around the target point which was excluded from the planar vertices (step S208). This is because the exclusion of the target point from the planar vertices in step S207 indicates that the planar vertices around the excluded point are generally not in the same plane and therefore it is necessary to generate new projective planes each made of three of such planar vertices.

As one specific example, a technique for generating polygonal faces, which is often used in the areas of CG and CAD, can be used. Although three points may be selected arbitrarily out of the planar vertices around the excluded point, the above technique is to try any possible selection pattern so as to select three points which provide as equal interior angles as possible, i.e., which form nearly a regular triangle, to form new projective planes each made of such three points as its vertices.

In FIG. 30B, new projective planes 206*b* are generated. While there are six projective planes 206*a* around the target point 209*a* in FIG. 30A, only four new projective planes 206*b* are generated in FIG. 30B. That is, the number of projective planes (i.e., target areas) is reduced.

Referring now to FIG. 28, whether or not all the target areas (projective planes) around the excluded point satisfy the first and second requirements is determined. Before that, the index i which specifies a target area (and a corresponding projective plane) is initialized to 1 (step S209).

As in the processing of steps S106 to S112 in the division/plane-generation operation of the second preferred embodiment, the maximum value H max of the foots of perpendiculars dropped from the i-th target area and meeting the corresponding projective plane is obtained (step S210), the unit normal vector nc at each point in the i-th target area is obtained (step S211), the unit normal vector np of the i-th projective plane is obtained (step S212), and the maximum inclination angle (max formed by the i-th target area and the i-th projective plane is obtained from the unit normal vectors nc and np (step S213).

Then, whether both the aforementioned first and second requirements are satisfied or not is determined (step S214). If both the requirements are not satisfied, the projective planes regenerated in step S208 and their corresponding target areas cannot be adopted; therefore, the excluded point 209*c* is restored to the planar vertices according to the data stored in step S203 and the projective planes therearound are also restored (step S215). In the example of FIGS. 30A and 30B, the state of FIG. 30B is returned to that of FIG. 30A. Then, the next point is selected as a target point in step S206 and the process returns to step S202.

On the other hand, when both the first and second requirements are satisfied in step S214, the index i is incremented by 1 (step S216).

It is then is determined whether or not the index i is not more than the maximum number m of regenerated projective planes (and their corresponding target areas) (i.e., the number of new projective planes 206*b* in FIG. 30B: m=4) (step S217). If the index i is more than the maximum number m, the next point is selected as a target point in step S206 and the process returns to step S202. On the other hand, if the index i is not more than the maximum number m, the process returns to step S210 and repeats the processing of steps S210 to S217. That is, in the processing of steps S210 to S217, only when all the regenerated projective planes of step S208 around the deleted target point of step S207 satisfy both the first and second requirements, those projective planes and their corresponding target areas are adopted. If any one of the regenerated projective planes fails to satisfy at least either of the first and second requirements, the deleted target point and the projective planes therearound are restored. In this fashion, the numbers of target points and projective planes are gradually reduced.

The processing of steps S203 to S217 is repeatedly performed as above described. After step S202 determines that all the points have been selected as target points, whether or not the above processing is repeated a predetermined number of times is determined (step S218 of FIG. 27). Until the above processing is repeated a predetermined number of times, the process continues to return to step S201. With the predetermined number of repetitions, the division/plane-generation operation is completed and the printing operation (cf. FIG. 23) is performed on the n target areas as in the second preferred embodiment.

As above described, the third preferred embodiment achieves the same effects as the second preferred embodiment.

The third preferred embodiment also permits high-precision, high-speed printing even on free-form surfaces given as point group data.

<4. Modifications>

While the aforementioned preferred embodiments give examples of the three-dimensional object printing apparatus and method, it is to be understood that the present invention is not limited thereto.

In each of the above preferred embodiments, printing on the whole surface of the printing object 228 is performed by repeating main scanning and sub-scanning of each target area in sequence, but main scanning and sub-scanning across the whole surface of the printing object 228 may be performed by changing the attitude and position of the ink-jet printhead 210 relative to the surface of the printing object 228 at every boundary between each target area.

Figure 31:
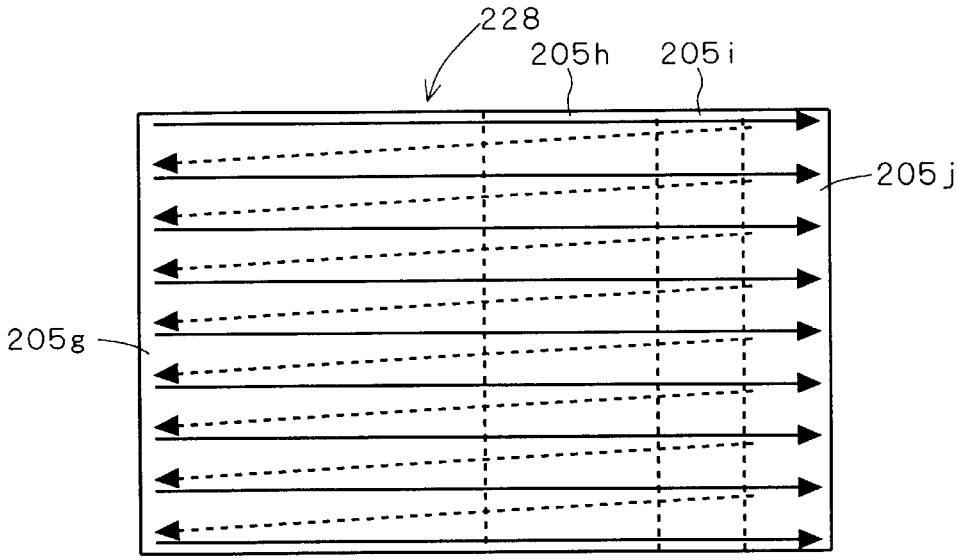
FIG. 31 illustrates a modification in scanning sequence.
Figure 32A:
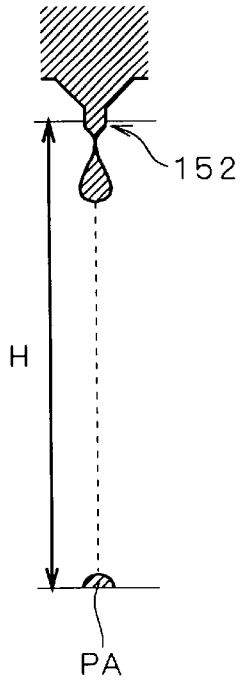
FIGS. 32A and 32B illustrate the directions of ink ejection from an ejection nozzle.
Figure 32B:
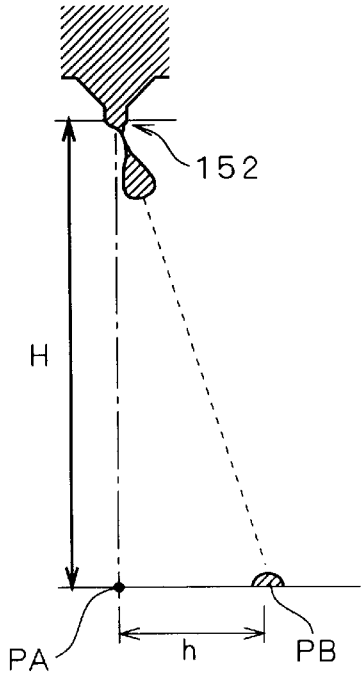

FIG. 31 is an explanatory diagram of such a modification in scanning sequence according to a modification. In this modification, main scanning across the whole surface of the printing object 228 is performed at a time. In FIG. 31, main scanning starts at a target area 205*g* and goes across target areas 205*h*, 205*i*, and 205*j* in sequence, then sub-scanning is performed at the endpoint of the target area 205*j*. Subsequent main scanning is performed along the next main-scanning line in the same order as above described.

In this case, however, the main-scanning drive motor is stopped at every boundary between each target area, during which each axis drive motor, namely roll, pitch, and yaw, is driven to change the attitude of the printing object 228 and the vertical drive motor 290 is driven to change the distance of the ink-jet printhead 210 from the printing object 228, so that the ink-jet printhead 210 can scan the next target area in parallel therewith with spacing of H max+δ. In the example of FIG. 31, the position of the ink-jet printhead 210 and the attitude of the printing object 228 are changed at the boundary between the target areas 205*g* and 205*h*.

Following this, main scanning of the next target area is performed. In the example of FIG. 31, main scanning of the target area 205*h* is performed along the same scanning line as before.

By repetition of such control (in the example of FIG. 31, the same control is exercised over the target area 205*i*), the scanning reaches the end point of the main scanning direction (the right end of the target area 205*j* in FIG. 31) on the surface of the printing object 228, and then sub-scanning control is performed. In the same manner, main scanning is repeated from the first target area (the target area 205*g* in FIG. 31). Meanwhile, print control is exercised as in the first preferred embodiment.

As above described, main scanning and sub-scanning across the whole surface of the printing object 228 are performed by changing the attitude and position of the ink-jet printhead 210 relative to the surface of the printing object 228 at every boundary between each target area. This facilitates scan path control.

Such scan path control is applicable to a printing object 228 of any shape but especially effective when the surface of the printing object 228 has small variations in shape with respect to the main scanning direction, because in such a case not many changes to the attitude of the ink-jet printhead 210 are made at every boundary between each target area and thus scanning can be performed without so much reducing the printing speed.

While in the aforementioned third preferred embodiment the processing of steps S201 to S217 is repeated a predetermined number of times according to the determination in step S218 of FIG. 27, the processing may be repeated until there is no target point to be deleted, by always checking whether or not any target point has been deleted during the processing of steps S201 to S217.

While the invention has been shown and described in detail, the foregoing description is in all aspects illustrative and not restrictive. It is therefore understood that numerous modifications and variations can be devised without departing from the scope of the invention.

What is claimed is:

1. An apparatus for supplying ink to a surface of a three-dimensional object, comprising:

an ejection head with a plurality of nozzles for ejecting ink to the surface of said three-dimensional object located opposite said nozzles;

a scanning section for causing said ejection head to scan the surface of said three-dimensional object; and a controller for enabling predetermined nozzles and disabling the other nozzles out of said plurality of nozzles in accordance with a shape of the surface of said three-dimensional object located opposite said ejection head, thereby to control scanning by said scanning section and ink ejection by said ejection head.

2. The apparatus according to claim 1, wherein said scanning section causes said ejection head to perform scanning in close proximity to said three-dimensional object while maintaining a minimum clearance therebetween, and said controller disables nozzles which are at more than a predetermined permissible distance away from the surface of said three-dimensional object, out of said plurality of nozzles.

3. The apparatus according to claim 2, wherein said permissible distance is variable.

4. The apparatus according to claim 3, wherein said permissible distance varies according to the setting determined by an operator.

5. The apparatus according to claim 3, wherein said permissible distance varies according to the shape of said three-dimensional object.

6. The apparatus according to claim 3, wherein said permissible distance varies according to an image to be printed on the surface of said three-dimensional object.

7. The apparatus according to claim 6, wherein said permissible distance is set shorter in an edge portion of said image than in the other portions thereof.

8. The apparatus according to claim 2, further comprising:

a changing section for changing the attitudes of said ejection head and said three-dimensional object.

9. The apparatus according to claim 8, wherein said changing section changes said attitudes so as to increase the number of nozzles to be enabled out of said plurality of nozzles.

10. The apparatus according to claim 2, wherein said scanning section is so configured as to cause said ejection head to perform linear scanning within a predetermined range in part of its scanning operation, and said controller controls ink ejection during said linear scanning by using only nozzles which are enabled at all times during said linear scanning within said predetermined range.

11. The apparatus according to claim 1, wherein said controller approximates said three-dimensional object by a three-dimensional model made of a plurality of polygons and determines nozzles to be enabled out of said plurality of nozzles for each of said polygons.

12. A method of supplying ink to a surface of a three-dimensional object, comprising the steps of:

a) locating said three-dimensional object opposite an ejection head with a plurality of nozzles for ejecting ink;

b) causing said ejection head to scan the surface of said three-dimensional object; and c) enabling predetermined nozzles and disabling the other nozzles out of said plurality of nozzles in accordance with a shape of the surface of said three-dimensional object located opposite said ejection head, thereby to eject ink from said enabled nozzles during said scanning.

13. The method according to claim 12, wherein said step b) includes the step of causing said ejection head to perform scanning in close proximity to said three-dimensional object while maintaining a minimum clearance therebetween, and said step c) is for disabling nozzles which are at more than a predetermined permissible distance away from the surface of said three-dimensional object, out of said plurality of nozzles.

14. The method according to claim 12, wherein said step c) includes the step of approximating said three-dimensional object by a three-dimensional model made of a plurality of polygons and determining nozzles to be enabled out of said plurality of nozzles for each of said polygons.

* * * * *